US008268040B2

(12) United States Patent
Boyden et al.

(10) Patent No.: US 8,268,040 B2
(45) Date of Patent: Sep. 18, 2012

(54) METHOD OF CONTROLLING THE ORDER OF RAPPING THE COLLECTING ELECTRODE PLATES OF AN ESP

(75) Inventors: Scott A. Boyden, Bellingham, WA (US); Anders Karlsson, Braas (SE)

(73) Assignee: ALSTOM Technology Ltd, Baden (CH)

( * ) Notice: Subject to any disclaimer, the term of this patent is extended or adjusted under 35 U.S.C. 154(b) by 459 days.

(21) Appl. No.: 12/530,109

(22) PCT Filed: Mar. 4, 2008

(86) PCT No.: PCT/US2008/055776

§ 371 (c)(1), (2), (4) Date: Oct. 21, 2009

(87) PCT Pub. No.: WO2008/109592

PCT Pub. Date: Sep. 12, 2008

(65) Prior Publication Data

US 2010/0037766 A1 Feb. 18, 2010

(30) Foreign Application Priority Data

Mar. 5, 2007 (EP) ..... 07103504

(51) Int. Cl.
*B03C 3/76* (2006.01)

(52) U.S. Cl. ..... 95/5; 95/25; 95/26; 95/76; 96/20; 96/25; 96/26; 96/31; 96/32; 323/903

(58) Field of Classification Search ..... 95/2, 5, 95/25, 26, 76, 3; 96/18, 20, 25, 26, 30–38, 96/19; 323/903

See application file for complete search history.

(56) References Cited

U.S. PATENT DOCUMENTS

| | | | | |
|---|---|---|---|---|
| 2,858,900 | A | 11/1958 | Foley | |
| 3,606,733 | A | 9/1971 | Arstikaitis | |
| 4,111,669 | A | 9/1978 | League, IV | |
| 4,285,024 | A * | 8/1981 | Andrews | 96/25 |
| 4,290,003 | A * | 9/1981 | Lanese | 323/241 |
| 4,432,062 | A * | 2/1984 | Herklotz et al. | 95/26 |

(Continued)

FOREIGN PATENT DOCUMENTS

| | | |
|---|---|---|
| JP | 7288/62 | 7/1962 |

(Continued)

OTHER PUBLICATIONS

PCT International Search Report and the Written Opinion of the International Searching Authority dated Jun. 24, 2008—(PCT/US08/55776).

European Search Report dated Aug. 8, 2007—(EP 07 10 3504).

*Primary Examiner* — Richard L Chiesa
(74) *Attorney, Agent, or Firm* — Rita D. Vacca

(57) ABSTRACT

A method and a system for controlling dust particle emissions from an electrostatic precipitator (1), which has a first and a second bus-section (16, 20), are provided. Dust particle emissions are controlled by observing that a rapping event of the first bus-section (16) is about to be initiated, verifying, before allowing the rapping event of the first bus-section (16) to be initiated, that the second bus-section (20) is ready to receive the dust particles to be released during the rapping event of the first bus-section (16), and then initiating, after verification, the rapping event of the first bus-section (16).

17 Claims, 10 Drawing Sheets

U.S. PATENT DOCUMENTS

| | | | | |
|---|---|---|---|---|
| 4,502,872 | A | 3/1985 | Ivester et al. | |
| 4,521,223 | A * | 6/1985 | Daar et al. | 95/6 |
| 6,336,961 | B1 * | 1/2002 | Terai et al. | 96/20 |
| 6,540,812 | B2 * | 4/2003 | Farmer et al. | 95/2 |
| 6,783,575 | B2 | 8/2004 | Pasic et al. | |
| 7,001,447 | B1 * | 2/2006 | Altman et al. | 95/74 |
| 2005/0178265 | A1 * | 8/2005 | Altman et al. | 95/2 |

FOREIGN PATENT DOCUMENTS

| | | |
|---|---|---|
| JP | 164665/86 | 7/1986 |
| JP | 253868/90 | 10/1990 |
| JP | 2002-18318 | 1/2002 |
| JP | 2002-233790 | 8/2002 |
| WO | WO 91/08837 | 6/1991 |
| WO | WO 97/41959 | 11/1997 |

* cited by examiner

METHOD OF CONTROLLING THE ORDER OF RAPPING THE COLLECTING ELECTRODE PLATES OF AN ESP

The present application is the national stage of and claims priority to International Application No. PCT/US08/55776 entitled "A METHOD OF CONTROLLING THE ORDER OF RAPPING THE COLLECTING ELECTRODE PLATES OF AN ESP" filed on Mar. 4, 2008, the disclosure of which is incorporated herein by reference in its entirety.

FIELD OF THE INVENTION

The present invention relates to a method of controlling the dust particle emission from an electrostatic precipitator.

The present invention also relates to a control system for controlling the operation of an electrostatic precipitator.

BACKGROUND OF THE INVENTION

Combustion of coal, oil, industrial waste, domestic waste, peat, biomass, etc. produces flue gases that contain dust particles, often referred to as fly ash. Emission of dust particles to ambient air needs to be kept at a low level and therefore a filter of the electrostatic precipitator (ESP) type is often used for collecting dust particles from the flue gas before the flue gas is emitted to the ambient air. ESP's, which are known from, among other documents, U.S. Pat. No. 4,502,872, are provided with discharge electrodes and collecting electrode plates. The discharge electrodes charge dust particles which are then collected at the collecting electrode plates. The collecting electrode plates are occasionally rapped to make the collected dust release from the plates and fall down into a hopper from which the dust may be transported to landfill, processing etc. The cleaned gas is emitted to ambient air via a stack.

An ESP has a casing which encloses the discharge electrodes and the collecting electrodes and functions as a flue gas duct through which the flue gas flows from a flue gas inlet, past the discharge and collecting electrodes, and to a flue gas outlet. The ESP may contain, inside the casing, several independent units, also called fields, coupled in series. An example of this can be found in WO 91/08837 describing three individual fields coupled in series. Further each of such fields may be divided into several parallel units, which are often referred to as cells or bus-sections. Each such bus-section may be controlled, as regards rapping, power, etc, independently of the other bus-sections.

With more stringent demands for very low dust particle emissions from the ESP's it has become necessary to use a higher number of fields in series inside the casing of the ESP in order to obtain a very efficient removal of dust particles in the ESP. While an increased number of fields is effective to reduce the emission it also increases the investment and operating cost of the ESP.

SUMMARY OF THE INVENTION

An object of the present invention is to provide a method which makes it possible to control an electrostatic precipitator (ESP) in a way that increases its removal capability. The benefits of such increased removal capability could be utilized in such a way that stricter demands for low dust particle emissions can be met with a minimum size of the ESP, i.e., a minimum number of fields in series, and/or a minimum residence time in the ESP, and/or a minimum collecting electrode area, and/or smaller fields, as regards the number of collecting electrodes, the collecting electrode size, etc., and also for improving the dust removal efficiency of existing ESP's.

This object is achieved by a method of controlling the dust particle emission from an electrostatic precipitator, the method being characterized in utilizing in said electrostatic precipitator at least a first bus-section and at least a second bus-section, each of which comprising at least one collecting electrode plate, at least one discharge electrode, and a power source, observing that a rapping event of the first bus-section is about to be initiated, said rapping event comprising rapping at least one collecting electrode plate of the first bus-section for the purpose of removing dust particles accumulated thereon, verifying, before allowing the rapping event of said first bus-section to be initiated, that the second bus-section, which is located downstream of said first bus-section with respect to the flow direction of the flue gas in said electrostatic precipitator, is ready to receive the dust particles to be released during the rapping event of said first bus-section, and initiating, after it has been verified that said second bus-section is ready to receive the dust particles to be released during the rapping event of said first bus-section, said rapping event of said first bus-section.

An advantage of this method is that rapping of the first bus-section is not initiated until it has been verified that the second bus-section, which is located downstream of the first bus-section, is ready to receive the dust particles that will be released during the rapping of the first bus-section. In this way it can be avoided that the second bus-section becomes overloaded with dust particles, an overload which could cause an increased emission of dust particles. By operating the ESP in accordance with the present method, the emissions caused by the rapping of the first bus-section can be kept very low. The method thus provides for reducing the emission of dust particles from the ESP.

In accordance with one embodiment said second bus-section is located immediately downstream of said first bus-section. The rapping of the collecting electrode plates of a bus-section will usually have the strongest effect on the bus-section located immediately downstream thereof. For that reason it is often preferable to verify, before rapping the collecting electrode plates of the first bus-section, that the second bus-section, which is located immediately downstream of the first bus-section, is ready to receive the dust particles to be released during the rapping of the first bus-section.

In accordance with one embodiment said first bus-section is located at the flue gas inlet of the ESP. Usually a large portion of the dust particles entering the ESP will be removed already in that bus-section being located at the flue gas inlet. Consequently, rapping of a first bus-section located at the inlet of the ESP will occur frequently, and a quite large amount of dust particles will be released from the collecting electrode plates of such first bus-section each time a rapping event is initiated. Thus, verifying that the second bus-section, which is located downstream of said first bus-section being located at the inlet of the ESP, is ready to receive the dust particles to be released from the first bus-section during the rapping thereof, has a large positive impact on the efforts to reduce the dust particle emission from the ESP.

In accordance with one embodiment said ESP comprises any number of bus-sections, at least three of said any number of bus-sections forming a group of bus-sections, such group comprising at least a first bus-section, a second bus-section, which is located downstream, with respect to the flow direction of the flue gas in said ESP, of said first bus-section, and a third bus-section, which is located downstream, with respect to the flow direction of the flue gas in said ESP, of said second bus-section, the rapping of each of said bus-sections of said group of bus-sections being controlled by observing that a rapping event of one of the bus-sections of said group is about to be initiated, verifying, before allowing the rapping event of said one of the bus-sections to be initiated, that a bus-section comprised in said group and located immediately downstream of said one of the bus-sections is ready to receive the dust particles to be released during the rapping event of said one of the bus-sections, and initiating, after it has been verified that said bus-section comprised in said group and located immediately downstream of said one of the bus-sections is ready to receive the dust particles to be released during the rapping event of said one of the bus-sections, said rapping event of said one of the bus-sections. In accordance with this embodiment a group of at least three bus-sections, located along the flow direction of the flue gas passing through the ESP, are controlled such that it is controlled, for each of such bus-sections, that the downstream bus-section is ready to receive the dust particles to be released during a rapping event. Hence, before rapping the first bus-section it is verified that the second bus-section is ready. If a rapping of the second bus-section is found to be necessary, then it is first controlled, prior to executing such a rapping of the second bus-section, that the third bus-section is ready. Consequently, in accordance with this embodiment, the control method comprises looking at the downstream bus-section, in what could be called a serial manner, before a rapping event is initiated.

In accordance with another embodiment said ESP comprises any number of bus-sections, an even number of said any number of bus-sections being divided into pairs of bus-sections, each such pair comprising a first bus-section, and a second bus-section, which is located downstream, with respect to the flow direction of the flue gas in said ESP, of said first bus-section, the rapping of said first and second bus-sections of each pair of said pairs being controlled by verifying that the second bus-section is ready to receive the dust particle emission to be released by the rapping of the first bus-section, prior to initiating a rapping event of said first bus-section. An ESP with seven consecutive bus-sections could have one, two or three such pairs, each such pair having a first bus-section and a second bus-section, while the last five, three, or the last one, of the seven bus-sections could be controlled in accordance with other principles. An advantage of this embodiment is that each pair will operate as a "collector-safeguard-combination", in which the first bus-section of the pair will function as the main collector of dust particles, while the second bus-section of the pair will operate as a safeguard for the purpose of decreasing the emission of dust particles from the pair. Thus, each such pair, comprising a first bus-section and a second bus-section, will be operative to achieve efficient removal of dust particles and low emissions.

In accordance with one embodiment the ESP could have at least two pairs of first and second bus-sections; the first pair could comprise the first two bus-sections of the ESP, as seen in the flow direction of the flue gas passing through the ESP, and the second pair could comprise the third and fourth bus-sections of the ESP. Each pair would preferably, in this embodiment, be controlled independently from the other pair with respect to the rapping.

The step of verifying that the second bus-section is ready to receive the dust particles to be released during the rapping event of the first bus-section could be executed in various manners. In accordance with one embodiment the time that has elapsed since said second bus-section was last rapped is determined. If said time that has elapsed since said second bus-section was last rapped exceeds a selected time, a rapping event of said second bus-section is initiated, such that at least one collecting electrode plate of said second bus-section is rapped. Checking the time that has elapsed since the second bus-section was last rapped constitutes a simple way of estimating whether or not the collecting electrode plates of the second bus-section can be expected to be clean enough to receive the dust particles to be released during the rapping event of said first bus-section. In accordance with another embodiment the sparking rate in the second bus-section is measured for the purpose of evaluating whether or not the second bus-section is ready to receive the dust particles to be released during the rapping event of said first bus-section. The sparking rate in the second bus-section is thus taken as an indication of how clean the collecting electrode plates of the second bus-section are. In accordance with yet a further embodiment the need for rapping said at least one collecting electrode plate of said second bus-section is predicted. Such prediction could be based on flue gas flow, boiler load, type of fuel combusted, time elapsed since the previous rapping event of the second bus-section, etc., alone or in combination. It is, for example, possible to utilize a prediction model, e.g., a mathematical model, for predicting the need for rapping the second bus-section. Such prediction model could utilize input of operating parameters influencing the amount of dust on the collecting electrode plates of the second bus-section, such as those parameters mentioned hereinbefore. In accordance with yet another embodiment a rapping event of said second bus-section is initiated prior to rapping the first bus-section, such that at least one collecting electrode plate of said second bus-section is rapped, prior to said step of initiating said rapping event of said first bus-section. In this way at least one of the collecting electrode plates of the second bus-section will be rapped just before initiating the rapping event of the first bus-section, thereby making the second bus-section at least partly ready to receive the dust particles to be released during the rapping event of said first bus-section. If the sequence of steps of the present invention is run many consecutive times, resulting in several steps of verifying that the second bus-section is ready to receive the dust particles to be released during the rapping event of the first bus-section, then it can be decided that a rapping event of said second bus-section is to be executed only every second, or every third, etc., time such a step of verifying is executed.

Another object of the present invention is to provide a control system, which is adapted for controlling the operation of an electrostatic precipitator (ESP) in such a manner that the emission of dust particles can be reduced.

This object is achieved by a control system for controlling the operation of an ESP, said control system being characterised in comprising a control device being adapted for receiving input to the effect that a rapping event of a first bus-section of the ESP is about to be initiated, said rapping event comprising rapping at least one collecting electrode plate of the first bus-section for the purpose of removing dust particles accumulated thereon, said control device being adapted for sending, in response to said input to the effect that a rapping event of a first bus-section of the ESP is about to be initiated, an inquiry to a second bus-section, which is located downstream of said first bus-section with respect to the flow direction of the flue gas in the ESP, concerning whether said second bus-section is ready to receive the dust particles to be released during the rapping event of said first bus-section, said control device being adapted for initiating, after it has been verified that said second bus-section is ready to receive the dust particles to be released during the rapping event of said first bus-section, said rapping event of said first bus-section.

An advantage of this control system is it is adapted for verifying that the second bus-section, which is located downstream of the first bus-section, is ready to receive the dust particles that will be released during the rapping of the first bus-section before initiating a rapping event of the first bus-section. Thus, the control system is operative for avoiding that the second bus-section becomes overloaded with dust particles.

A further control system is characterized in comprising a control device being adapted for receiving input to the effect that a rapping event of a first bus-section of the ESP is about to be initiated, said rapping event comprising rapping at least one collecting electrode plate of the first bus-section for the purpose of removing dust particles accumulated thereon, said control device being adapted for at least occasionally initiating, in response to said input to the effect that a rapping event of the first bus-section of the ESP is about to be initiated, a rapping event in a second bus-section, which is located downstream of the first bus-section with respect to the flow direction of the flue gas in the ESP, said control device being adapted for initiating said rapping event of the first bus-section, possibly after initiating the rapping event of the second bus-section.

An advantage of this further control system is that it is operative for decreasing, in a simple manner, the amount of dust present on at least one collecting electrode of the second bus-section prior to initiating the rapping event of the first bus-section. Thereby the emission of dust particles caused by the rapping event of the first bus-section is decreased. The control system can be designed so as to always initiate a rapping of the second bus-second when the control system has received input to the effect that a rapping event of a first bus-section of the ESP is about to be initiated. Another possibility is to initiate a rapping of the second bus-section every second, every third, etc., time a rapping event is about to be initiated in the first bus-section. If the amount of dust particles to be released during the rapping event of the first bus-section is rather low, then it may very well be sufficient to initiate a rapping event in the second bus-section only every second, every third, etc., time a rapping event is initiated in the first bus-section.

Further objects and features of the present invention will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
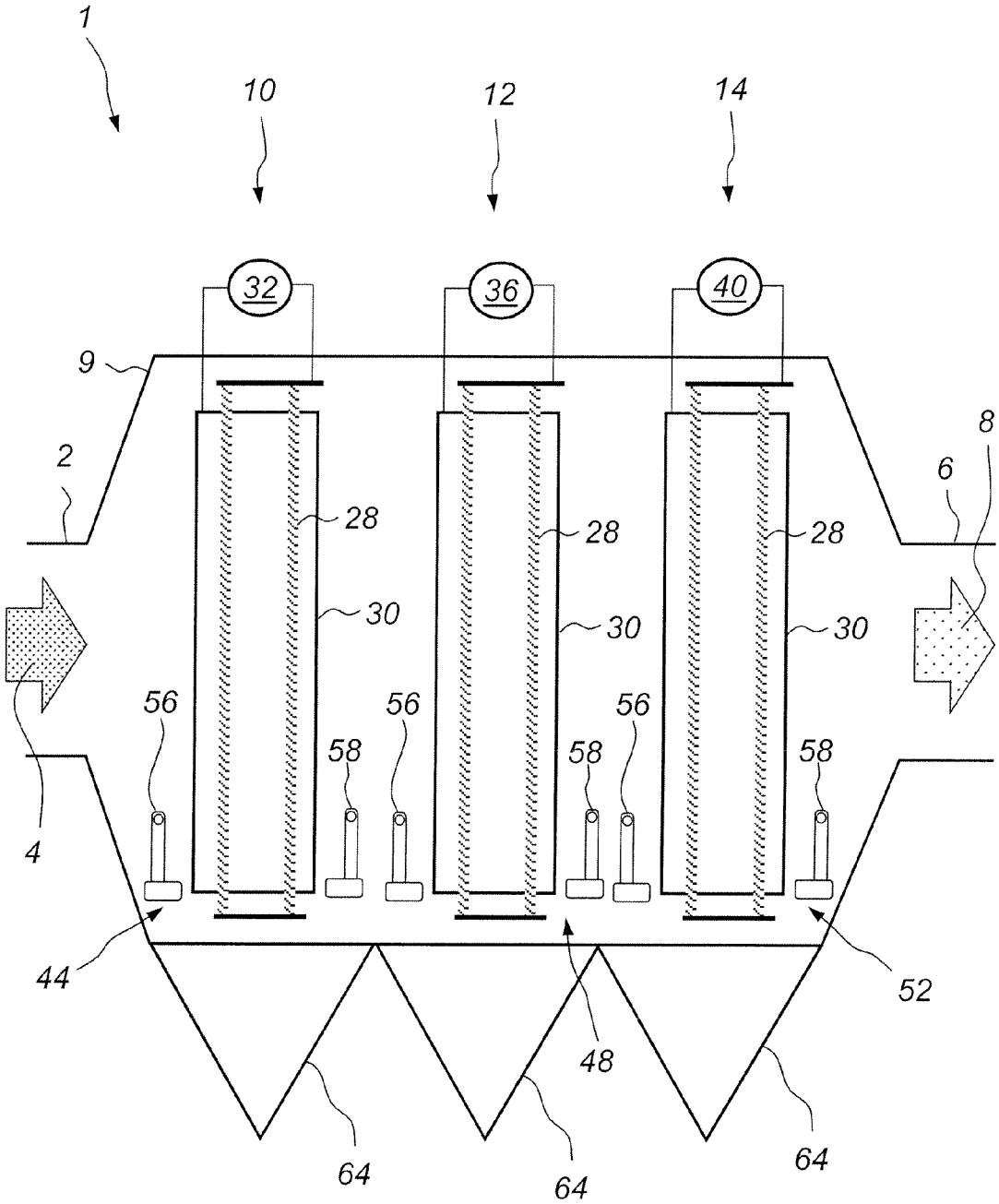
FIG. 1 is a cross-sectional view and shows an electrostatic precipitator as seen from the side.
Figure 2:
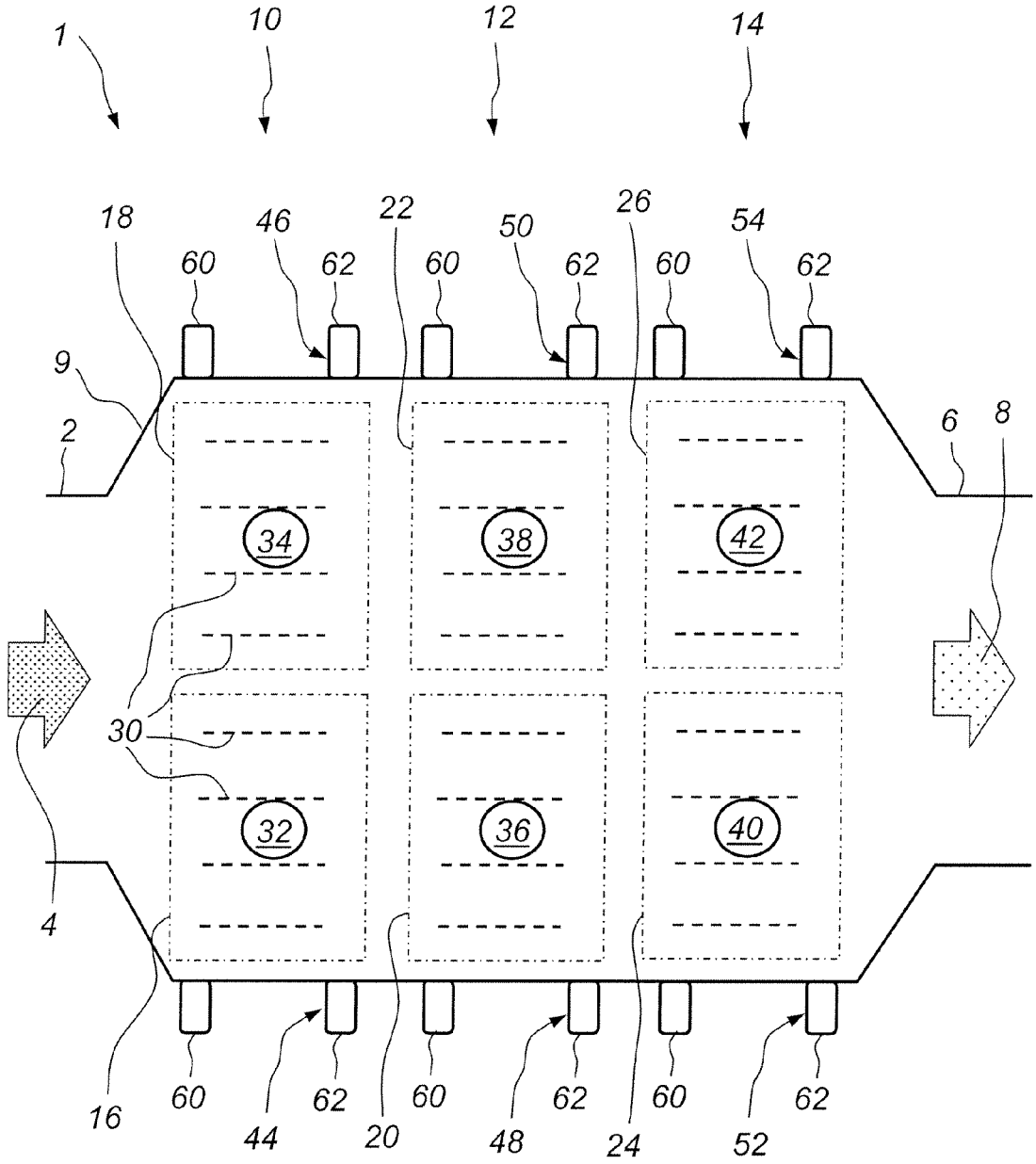
FIG. 2 is a top-view and shows the electrostatic precipitator as seen from above.

FIG. 1 shows schematically an electrostatic precipitator (ESP) 1 as seen from the side and in cross-section. FIG. 2 shows the same precipitator 1 as seen from above. The precipitator 1 has an inlet 2 for flue gas 4 that contains dust particles and an outlet 6 for flue gas 8 from which most of the dust particles have been removed. The flue gas 4 may, for instance, come from a boiler in which coal is combusted. The precipitator 1 has a casing 9 in which a first field 10, a second field 12 and a third, and last, field 14, are provided. Each field 10, 12, 14 is provided with discharge electrodes and collecting electrode plates as is known in the art, for instance from U.S. Pat. No. 4,502,872, which is hereby incorporated by this reference.

As is best shown in FIG. 2 each field 10, 12, 14 is divided into two parallel independent units, called bus-sections. A bus-section is defined as a unit having at least one collecting electrode plate, at least one discharge electrode, and at least one power source for applying a voltage between the collecting electrode plate/-s and the discharge electrode/-s. Thus the field 10 has a bus-section 16 and a parallel bus-section 18, field 12 has a bus-section 20 and a parallel bus-section 22, and field 14 has a bus-section 24 and a parallel bus-section 26.

Each bus-section 16, 18, 20, 22, 24, 26 is provided with discharge electrodes 28, shown in FIG. 1, and collecting electrode plates 30, shown in FIG. 1 and indicated in phantom in FIG. 2. Each of the bus-sections 16-26 is provided with an independent power source in the form of a rectifier 32, 34, 36, 38, 40, 42, respectively, which applies a current and a voltage between the discharge electrodes 28 and the collecting electrode plates 30 of that specific bus-section 16-26. When the flue gas 4 passes the discharge electrodes 28, the dust particles will become charged and travel towards the collecting electrode plates 30 where the dust particles will be collected. Each bus-section 16-26 is provided with an individual rapping device 44, 46, 48, 50, 52, 54, respectively, each of which being operative to remove the collected dust from the collecting electrode plates 30 of the respective bus-section 16-26. A non limiting example of such a rapping device with so called tumbling hammers can be found in U.S. Pat. No. 4,526,591. Each of the rapping devices 44-54 comprises a first set of hammers, of which only one hammer 56 is shown in FIG. 1 for each rapping device, adapted for rapping the upstream end of the respective one of the collecting electrode plates 30 associated therewith. Each of the rapping devices 44-54 also comprises a second set of hammers, of which only one hammer 58 is shown in FIG. 1 for each rapping device, adapted for rapping the downstream end of the respective one of the collecting electrode plates 30 associated therewith. Each of the rapping devices 44-54 comprises a first motor 60, shown in FIG. 2, adapted for operating the first set of hammers, i.e. the hammers 56, and a second motor 62, shown in FIG. 2, adapted for operating the second set of hammers, i.e. the hammers 58. When a rapping is performed, the collecting electrode plates 30 are accelerated, by getting hit by the hammers 56, 58, in such a way that the dust falls off the collecting electrode plates 30 in cakes. The rapping of the collecting electrode plates 30 thus results in that the dust particles collected on the collecting electrode plates 30 are released and are collected in hoppers 64, shown in FIG. 1, from which the collected dust particles are transported away. However, during the rapping of the collecting electrode plates 30 of a bus-section 16-26, some of the dust previously collected on the collecting electrode plates 30 of the bus-section being rapped is re-entrained with the flue gas 4 and leaves the bus-section in question with the flue gas 8. Thus every rapping results in a dust emission peak, which may have a size anywhere from large to almost undetectable depending on which one of the bus-sections 16-26 is rapped, how and when that one of the bus-sections 16-26 is rapped, and what the conditions are of the other bus-sections of the ESP. The cleaning of the collecting electrode plates 30 of a bus-section 16-26 could be done in different ways. Each rapping of the collecting electrode plates 30 of a bus-section 16-26 can be referred to as a "rapping event", which typically lasts for about 10 seconds to 4 minutes, usually 10-60 seconds. The rapping events can be performed in different ways and at different time intervals. In this regard one parameter that can be varied is the current situation, i.e., whether the rectifier 32-42 of that specific bus-section 16-26 does or does not apply a current to the electrodes 28, 30 during the rapping event. The ability of the particles to stick to the collecting electrode plates 30 during rapping will be higher if the current is applied during the rapping of the collecting electrode plates 30, than if the current is not applied during the rapping. If current is applied when a collecting electrode plate 30 is rapped, some of the dust cake sticks to the collecting electrode plate, so while there is less re-entrainment of dust particles, the collecting electrode plate 30 is also not as "clean" at the end of the rapping event, compared to rapping the collecting electrode plate 30 with no current applied, or with a low current applied, such as, e.g., 5% of the normal current. One example of how the voltage situation can be varied during the rapping is described in WO 97/41958. Another parameter that can be varied is whether the rapping is made with both the first set of hammers, i.e. the hammers 56, and the second set of hammers, i.e. the hammers 58, on the same occasion or with only one of the sets of hammers 56, 58. The number of times the hammers 56, 58 are made to rap the collecting electrode plates 30 will also influence how much of the dust particles on the collecting electrode plates 30 that is removed during the rapping event. Thus, there are many ways of rapping the collecting electrode plates 30 and each way of rapping will have a slightly different behaviour as regards the amount of dust particles that are removed from the collecting electrode plate 30 and also as regards, which will be shown below, the amount of dust particles that are dispersed in the flue gas and leave the bus-section, or even the precipitator 1, with the cleaned flue gas 8.

Figure 3:
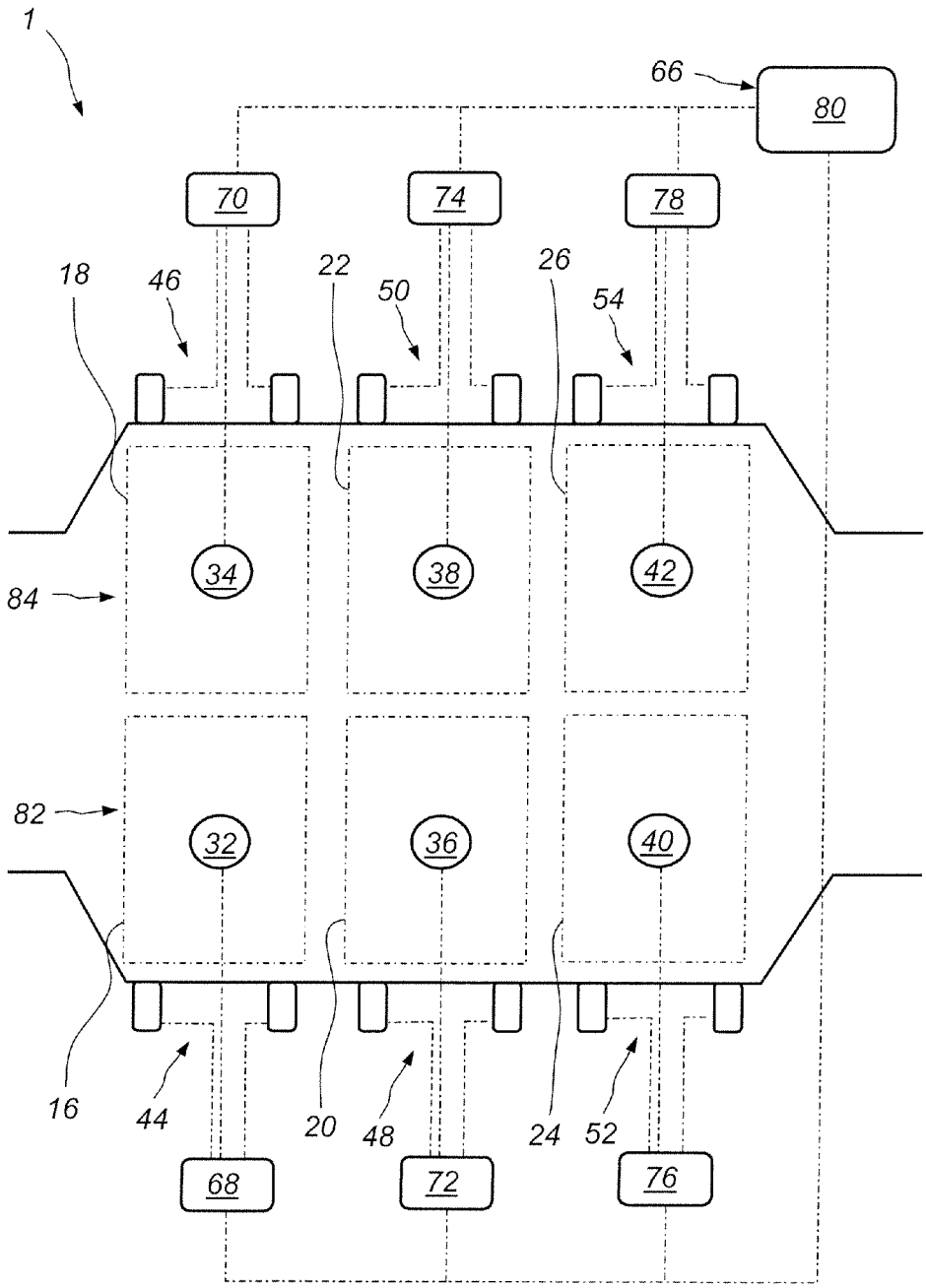
FIG. 3 is a top-view and illustrates the control system of the electrostatic precipitator.

FIG. 3 shows a control system 66 controlling the operation of the electrostatic precipitator 1. The control system 66 comprises six control units 68, 70, 72, 74, 76, 78 and a control device in the form of a central process computer 80. Each bus-section 16-26 is provided with an individual control unit 68, 70, 72, 74, 76, 78, respectively. The control unit 68-78 controls the operation of the corresponding rectifier 32-42 of the bus-section 16-26 in question. Such control includes control of the voltage/current supplied and counting the number of spark-overs. A "spark-over" is defined as a situation when a spark arises between a discharge electrode and a collecting electrode plate due to the fact that the voltage between the discharge electrode and the collecting electrode plate exceeds the dielectric strength of the gap between such electrodes. At the instance of the spark-over the electrodes are grounded, such that all electrical power available in the system is consumed. As a consequence the voltage between the electrodes drops temporarily to zero volts, which is detrimental to the collecting capability of the collecting electrode plate. After a spark-over the control unit 68-78 reduces the voltage, and then starts to increase it again. The control unit 68-78 of the respective bus-section 16-26 also controls the operation of the corresponding rapping device 44-54 of that respective bus-section 16-26. As indicated above, this control includes when and how the collecting electrode plates 30 are rapped. The central process computer 80 controls the control units 68-78 and thereby controls the operation of the entire electrostatic precipitator 1.

According to prior art technology, the rapping of the collecting electrode plates 30 is controlled to occur at preset time intervals. The preset time intervals are different for the different bus-sections 16-26, due to the fact that a larger amount of dust particles will be collected in bus-sections 16 and 18 of the first field 10 than in the bus-sections 24 and 26 of the third and last field 14. Thus rapping could, according to prior art technology, as an example be performed every 5 minutes for the first field 10, every 30 minutes for the second field 12 and every 12 hours for the last field 14. It has been found that this type of control is not optimal and provides an increased dust particle emission and increased power consumption.

The present invention provides for novel and inventive methods of controlling the rapping of an electrostatic precipitator.

According to a first aspect of the present invention it has been found that it is possible to detect when the collecting electrode plates 30 of a bus-section 16-26 have collected such an amount of dust particles that a rapping event is required in order not to deteriorate the dust particle removal capability of the bus-section 16-26 in question. Thus, it has been found possible to detect when the collecting electrode plates 30 of a bus-section 16-26 are full and require rapping.

Figure 4:
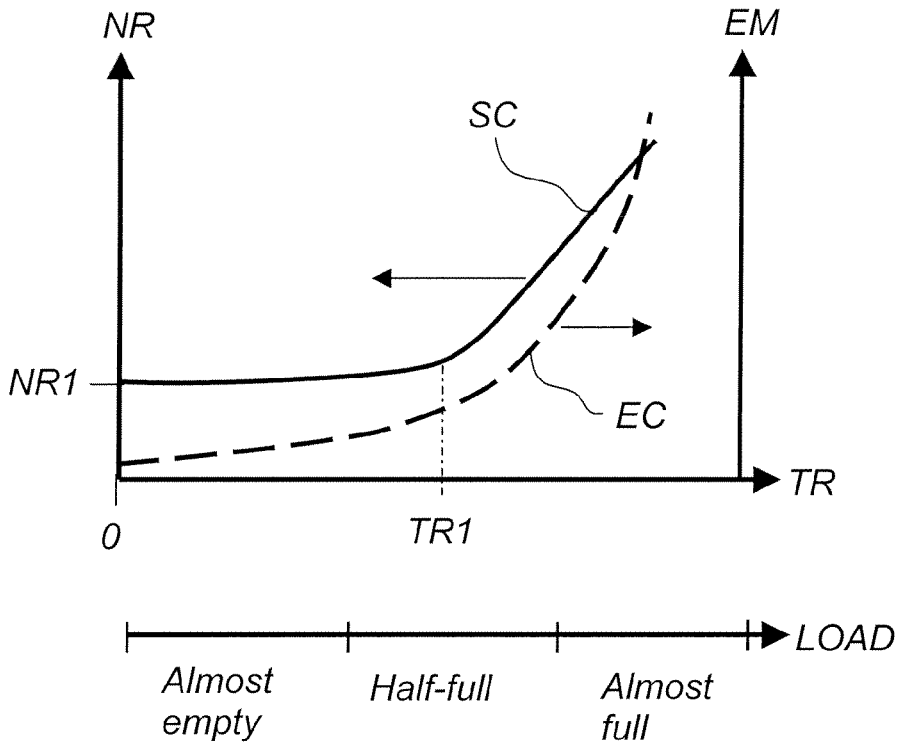
FIG. 4 is a diagrammatical illustration of the sparking rate and the emission of dust particles.

FIG. 4 is a diagrammatic illustration of the emission of dust particles EM, the dust particle emission being illustrated by the curve EC, from bus-section 16 as correlated to the time TR elapsed since the collecting electrode plates 30 of that bus-section 16 were rapped. As can be seen from a reference to FIG. 4, the emission of dust particles EM, illustrated on the right y-axis of FIG. 4, starts at a very low level when the collecting electrode plates 30 have just been rapped (TR=0) and then gradually increases as the collecting electrode plates 30 become more filled with dust particles. Thus, the curve EC represents an indirect measure of the amount of dust particles that have been collected on the collecting electrode plates 30 of the bus-section 16, i.e., the curve EC represents, indirectly, the present load of dust particles on the collecting electrode plates 30 of the bus-section 16, versus the time since the rapping of those collecting electrode plates 30. In FIG. 4 that present load of dust particles which corresponds to a certain present emission of dust particles EC is given on the lower x-axis, which is denoted "LOAD", in three discrete levels; "Almost empty", "Half-full", and "Almost full". Clearly it would be of interest to initiate a rapping event when the emission of dust particles increases rapidly, i.e., some time after TR1. However, measuring the dust particle emission just after each individual bus-section 16-26 is expensive and therefore controlling the rapping based on measured dust particle emission after bus-section 16 is not an attractive control principle. Measuring the actual dust load in kilograms, by means of, e.g., load cells, on the collecting electrode plates 30 of a bus-section 16 is also expensive and difficult.

In accordance with one embodiment of the first aspect of the present invention, it has been found that the sparking rate, i.e., the number of spark-overs per unit of time, in one bus-section, e.g., the bus-section 16, could be used for controlling the rapping of that one bus-section, e.g., the bus-section 16. Furthermore, it has been found that the sparking rate of said one bus-section, e.g., bus-section 16, correlate to the curve EC, i.e., to the dust particle emission from that one bus-section. Thus, as will be described hereinafter, the measured present sparking rate can be utilized as an indirect measure of the present dust particle emission EC from the bus-section 16. The measured sparking rate can also, due to the fact that the dust particle emission EC indirectly represents the load of dust particles on the collecting electrode plates 30, be utilized as an indirect measure of the load of dust particles on the collecting electrodes 30. The number of spark-overs per time unit, i.e., the sparking rate, is measured by the control unit 68 controlling the bus-section 16. Thus, the control unit 68 will function as a measurement device that measures the sparking rate of the bus-section 16. The bus-section 16 will itself function as a sensor that senses the spark-overs. As has been described hereinbefore, a spark-over means that the electrodes are grounded. When a spark-over occur, the applied current must be decreased and then ramped back up, during which time the collection efficiency is reduced. Thus, a large number of spark-overs will result in a decreased time during which the bus-section 16 operates at maximum current, and thus a reduced collecting efficiency. In accordance with prior art technology, the measured number of spark-overs is used for controlling the voltage or current supplied to the bus-section 16 by the rectifier 32. It has now been found that the sparking rate NR, given on the left y-axis of FIG. 4, as a function of the time TR has a characteristic appearance, as shown in curve SC in FIG. 4. As can be seen therefrom the curve SC starts at an initial sparking rate NR1 when the collecting electrode plates 30 have just been rapped (TR=0). For example, the NR1 of a bus-section 16 of a first field 10 may be about 10-40 spark-overs per minute. As the collecting electrode plates 30 of the bus-section 16 become more filled with collected dust particles the sparking rate increases slowly. After a time TR1, the sparking rate NR increases rapidly. For bus-section 16 the time TR1 could, for example, be 4 to 30 minutes. It has now been found that the rapid increase in sparking rate NR coincides with the rapid increase in the emission of dust particles EM. Thus, both the curve SC, indicating the sparking rate, and the curve EC, indicating the emission of dust particles, show a steep increase after the time TR1. It is, therefore, possible to use the sparking rate NR as a measure of when the collecting electrode plates 30 are "full" and need to be rapped in order to decrease the emission of dust particles. Furthermore, the load of dust particles on the collecting electrode plates 30 can be estimated from the measured sparking rate. The process computer 80, having in this respect the function of a correlation device, can be provided with the curve EC illustrated in FIG. 4. As alternative the control unit 68 could function as the correlation device. Based on the correlation between the measured present sparking rate and the curve EC of FIG. 4 the process computer 80 can estimate the present load of dust particles on the collecting electrode plates 30. Since the sparking rate curve SC and the dust particle emission curve EC often has a similar principal appearance, as illustrated in FIG. 4, the sparking rate can in many cases be correlated directly to the load of dust particles, without necessitating the use of the curve EC. While such estimation may give a rather rough output regarding such load, such as "Almost empty", "Half-full", and "Almost full", as is illustrated in FIG. 4, such information on the load of dust particles on the collecting electrode plates 30 of an individual bus-section, e.g., the bus-section 16, is still very useful information in the control of the electrostatic precipitator 1. In addition to the control of the timing for performing a rapping event in the bus-section 16, which control will be described hereinafter, such information can also be utilized for, e.g., detecting mechanical and electrical problems in the rapping devices, the collecting electrode plates, etc.

Figure 5:
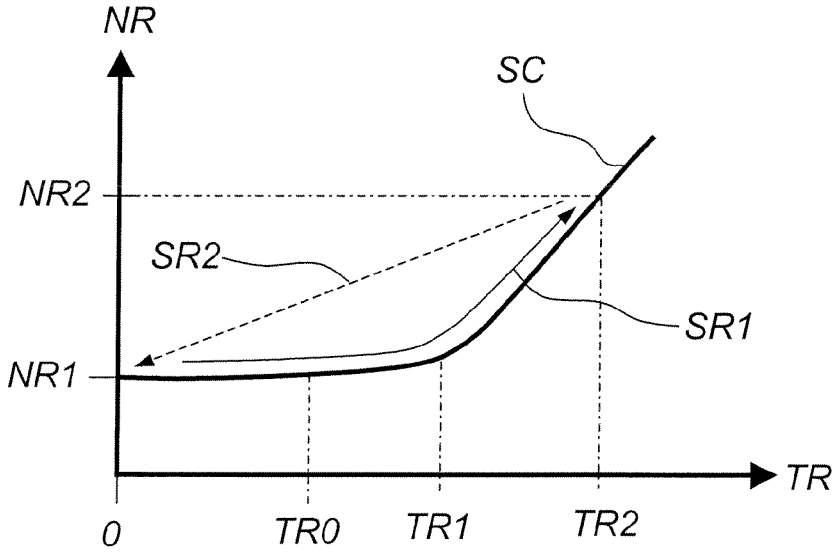
FIG. 5 is a diagrammatical illustration of the rapping controlled by sparking rate according to a first embodiment.

FIG. 5 illustrates a first embodiment of the manner in which the findings of FIG. 4 are implemented in a control method for controlling when it is time for the control unit 68 to cause the rapping device 44 to rap the collecting electrode plates 30 of the bus-section 16. According to this first embodiment the bus-section 16 itself is used as an on-line measurement device, operating to measure when the collecting electrode plates 30 have reached their maximum collecting capability, i.e., when the load of dust particles on the collecting electrode plates 30 has substantially reached its maximum, and the collecting electrode plates 30 thus need to be rapped. A particular advantage of using the bus-section 16 itself as part of an on-line measurement device is that all parameters that affect the collecting capability of the collecting electrode plates 30, such parameters including, e.g., the amount of flue gas 4, the fuel quality, the humidity and temperature of the flue gas 4, the physical and chemical condition of the collecting electrode plates 30, the physical and chemical properties of the dust particles, etc., are automatically and implicitly accounted for, because such control method reacts when the collecting electrode plates 30 cannot collect more dust particles without sparking, such sparking resulting in a decreased collecting efficiency, as will be described hereinafter. Thus, the bus-section 16 will form part of a measuring device measuring the load of collected dust particles on the collecting electrode plates 30. When the load of dust particles on the collecting electrode plates 30 has reached that amount at which, at the present conditions regarding flue gas humidity, temperature, etc., the collecting efficiency of the collecting electrode plates 30 starts to drop a rapping event is automatically initiated, such that the collecting efficiency of the collecting electrode plates 30 is restored. It will be appreciated that the bus-section 16 is operating as part of an on-line measurement device, without requiring any redesign of the mechanical structure compared to prior art bus-sections. Thus, it is easy to apply the first embodiment also to existing ESP's. According to this first embodiment, a control sparking rate NR2 is chosen, as illustrated in FIG. 5. For a bus-section 16 of the first field 10 the value NR2 could, for example, be 15 spark-overs per minute. The control unit 68 continuously monitors the sparking rate. After a rapping has been performed, the sparking rate will follow along the curve SC, as indicated by the arrow SR1. When the control unit 68 detects that the sparking rate NR has reached the preset value NR2, the control unit 68 causes the rapping device 44 to rap the collecting electrode plates 30 of the bus-section 16. The sparking rate NR then decreases, as indicated by a broken arrow SR2, as a result of such rapping. Thus, the rapping is controlled and made to occur as soon as the sparking rate has reached the preset value NR2. Since the amount of dust particles collected on the collecting electrode plates 30 may vary, depending on boiler load etc., the time TR2 corresponding to NR2 will not be constant. In contrast to prior art control strategies, the control method in accordance with the first embodiment of the present invention does not depend on time, but initiates a rapping when it is necessary, i.e., when the sparking rate has reached the value NR2, a value which corresponds to a rapidly increasing emission of dust particles, as shown in FIG. 4. Thus, in accordance with the first embodiment, changing loads, fuel quality, flue gas properties, etc., is accounted for automatically since a rapping is performed as soon as the collecting electrode plates 30 are "full" of collected dust particles, regardless of whether it takes 1 minute or 2 hours to get to that state. The sparking rate, which is measured on-line by means of the bus-section 16 and the control unit 68, is utilized as a measure of when it is time to rap the collecting electrode plates 30, said sparking rate taking all relevant parameters into account. Such control of when rapping needs to be performed automatically initiates a rapping when the collecting efficiency of the collecting electrode plates 30 is about to drop, and results in an increased average collecting efficiency of the bus-section 16.

The exact value of NR2 can be determined in different ways. One way is to perform a calibration measurement. In that measurement the emission of dust particles, EM, immediately after the bus-section 16 is measured continuously starting from a rapping and continuing thereafter. All operating data, such as the flue gas properties, the fuel quality and the fuel load, the settings of the rectifier 32, etc., should be kept as constant as possible. The emission of dust particles, immediately after the bus-section 16, can be measured in different manners. One manner is to perform an indirect measurement by analysing the voltage and/or current of the rectifier 36 of the bus-section 20 which is located immediately downstream of the bus-section 16. The emission of dust particles from the bus-section 16 will produce a "fingerprint" in the behaviour of the voltage and/or current of the rectifier 36 of the bus-section 20. For instance, an increased emission of dust particles from the bus-section 16 can be observed as an increase in the voltage of the rectifier 36 of the bus-section 20. Thus, it is possible to determine, indirectly, by studying the voltage of the rectifier 36 of the bus-section 20, when the emission of dust particles from the bus-section 16 reaches a maximum acceptable value. A further manner of measuring the emission of dust particles immediately after the first bus-section 16 is to employ a dust particle analyser, such as an opacity analyser, which is introduced between the bus-section 16 and the bus-section 20 in order to measure the emission of dust particles immediately after the bus-section 16. When the emission EM reaches the maximum allowable value, which has been preset for the bus-section 16, the corresponding control sparking rate NR2 is read from the control unit 68. The value of NR2 is then used to control the rapping and no further measurements of emission of dust particles is needed. It will be appreciated that tests could be performed in alternative ways for finding a suitable value for NR2 for a bus-section. It is also possible to use other criteria when finding the suitable value for NR2. One such alternative criteria for selecting the NR2 could be to strive towards a minimum number of rapping events in the bus-section 16, simultaneously with a minimum number of spark-overs in a downstream bus-section 20. The optimum value for NR2 will be specific for each bus-section of the electrostatic precipitator 1, since there is always some variation in the conditions, also between the parallel bus-sections 16, 18 of one field 10. Furthermore, there will also be differences between electrostatic precipitators having the same design, but installed in different power stations.

Suitable values of NR2 could be collected in a database. In such a database preferred values of NR2 for different fuels, different mechanical designs of collecting electrode plates, discharge electrodes and rapping devices, etc., could be collected. Then, when a new electrostatic precipitator 1 is to be employed, a suitable value for NR2, based on the data of that new electrostatic precipitator 1, can be found in the aforementioned database. In that way, no calibration measurements would need to be done for each specific installation of an electrostatic precipitator 1.

A further alternative of determining a suitable value of NR2 includes utilizing the control unit 68. The control unit 68 can be made to search for that time TR1 when the sparking rate starts to increase steeply. The control unit 68 may calculate the derivative of the curve SC. The time TR1 can be found at that point in time when the derivate of the curve SC suddenly increases. According to a conservative approach, the value of NR2 could be chosen as that value of sparking rate NR that corresponds to the time TR1. Such a conservative approach is not always preferable, because it may result in an unduly high frequency of initiating rapping events. The background is that the collected dust particles form so called dust "cakes" on the collecting electrode plates 30. When there is a long time between each rapping event, these cakes become compacted and as such have a larger mechanical strength and integrity. When the collecting electrode plates 30 are rapped a high strength dust cake will tend to fall into the hopper 64 with very little dust being remixed with the flue gas 8. Due to a desire to have the dust cakes as compact as possible before initiating a rapping event the value of NR2 can be chosen to be a higher value than that occurring at the time TR1. For instance, NR2 can be chosen to be the value of the sparking rate NR at TR=TR1+TR1*0.3. Thus, for instance, if it has been found by the above mentioned derivate of the curve SC that the time TR1 is 3 minutes, then NR2 can be chosen, when performing the calibration measurement, to be the value of NR corresponding to TR=3 min+54 s.

Insofar as prior art technology is concerned, it is respectfully submitted that there is no teaching therein of how many dust particles are present on the collecting electrode plates 30. Thus, it has usually been necessary to set a fixed time TR0 which should elapse between each rapping. This time TR0 has often been set, because of a lack of knowledge otherwise, to be quite short, as indicated, for example, in FIG. 5. By rapping at TR0, this means that the rapping will be made more often, which in turn means that the dust particle emission peaks associated with rapping will occur more often, and thus results in an increased amount of total dust particle emission. Further, because of the short time TR0 often associated with the use of prior art methods of control, the dust cake formed on the collecting electrode plates 30 may have a very low mechanical strength and integrity resulting in more of the collected dust particles being mixed with the flue gas at the rapping, compared to that, which is obtained with the present invention.

Figure 6:
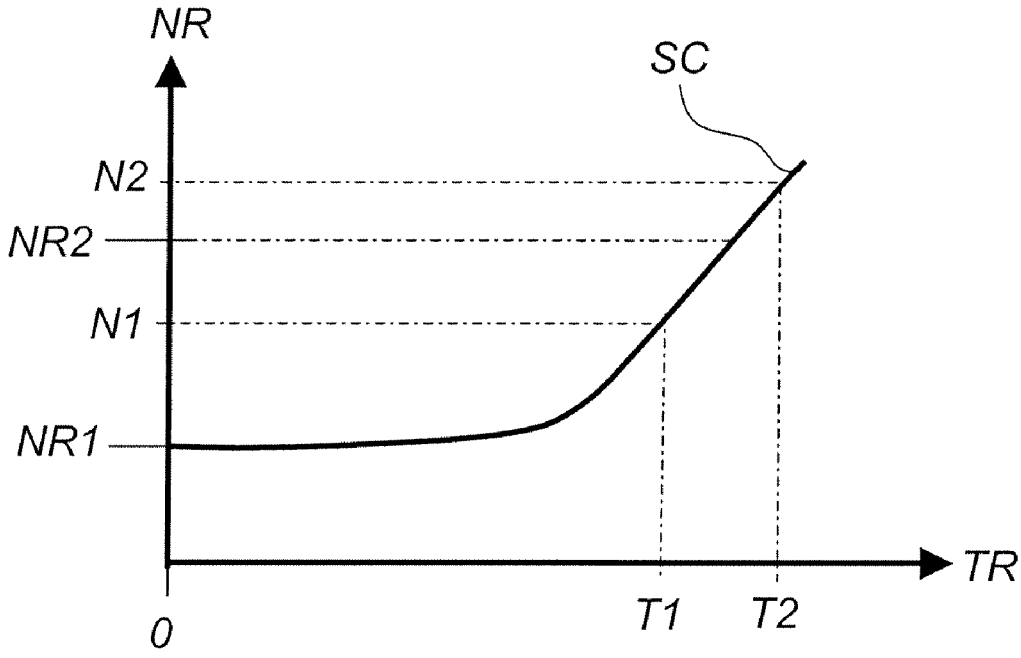
FIG. 6 is a diagrammatical illustration of the rapping controlled by sparking rate according to a second embodiment.

FIG. 6 illustrates a second embodiment of the manner in which the findings of FIG. 4 can be implemented in a control method for controlling when it is time for the control unit 68 to cause the rapping device 44 to rap the collecting electrode plates 30 of the bus-section 16. As best understood with reference to FIG. 6, the curve SC, illustrating the relation between the time TR and the sparking rate NR, as shown in FIG. 6, is identical to the curve SC shown in FIGS. 4 and 5. According to this second embodiment, the rapping device 44 performs rapping at a certain rapping rate, i.e., a certain number of rapping events per unit of time. The rapping rate is controlled by the sparking rate and is changed on a continuous basis with the aim of finding a rapping rate that starts a rapping event just as the sparking rate reaches a desired value. As an example, illustrating the principle of this second embodiment, the rapping rate may initially be set to 15 rapping events per hour. This means that the time to elapse between the start of each rapping event is 4 minutes. With reference to FIG. 6, a rapping event is started after a time T1 of 4 minutes has elapsed since the start of the immediately preceding rapping event. It should be noted that T1 is calculated from the start of the immediately preceding rapping event and thus the start of T1 is located before TR=0, since the latter indicates the finish of the immediately preceding rapping event. The sparking rate N1, at the time rapping is initiated, is, e.g., 10 spark-overs/minute. Since N1 is lower than a desired control sparking rate NR2 of 15 spark-overs/minute, the control unit 68 sets the rapping device 44 to decrease the rapping rate. For instance, the control unit 68 may decrease the rapping rate by setting the rapping device 44 to a rapping rate of 10 rapping events/hour, i.e., a time T2 of 6 minutes will elapse between the start of each rapping event. When the rapping is performed after a time T2 of 6 minutes, the sparking rate N2 may correspond to 17 spark-overs/minute. Since this is higher than the desired value NR2 of 15 spark-overs/minute the control unit 68 may then increase the rapping rate by setting the rapping device 44 to a rapping rate of 12.5 rapping events/hour. In this way the control unit 68 gradually tunes the rapping rate of the rapping device 44 to obtain a rapping rate wherein rapping is always performed when the sparking rate is close to the desired control sparking rate NR2. When the load on the boiler is changed, thereby changing the flue gas flow and/or the dust particle concentration in the flue gas 4, the rapping rate will be adjusted, that is, the rapping rate will be increased or decreased, by the control unit 68 to obtain such a rapping rate that the sparking rate, at the time the rapping is performed, is close to the desired control sparking rate NR2.

While FIG. 6 illustrates a simple way of finding a rapping rate that makes rapping occur when the sparking rate is as close to NR2 as possible, an alternative solution is to use e.g. a PID-controller which controls the rapping rate in such manner that rapping occurs when the sparking rate is as close to NR2 as possible, i.e. the PID-controller strives to find the rapping rate that, at the present conditions, initiates rapping when the sparking rate is close to NR2. Thus, the PID-controller strives to minimize the difference between the selected control sparking rate NR2 and that present sparking rate at which rapping occurs. Furthermore, it is possible to utilize an upper safety limit on sparking rate to ensure that the number of spark-overs do not exceed a predetermined value. When the present sparking rate reaches the upper safety limit on sparking rate a rapping event is immediately initiated. For instance, such an upper safety limit on sparking rate could, in the embodiment described hereinbefore with reference to FIG. 6, be 18 spark-overs/minute. Thus, if the measured present sparking rate reaches 18 spark-overs/minute a rapping is immediately ordered by the control unit 68. It is also possible to utilize a lower safety limit on sparking rate, to ensure that rapping does not occur to early. Such a lower safety limit on sparking rate could be 8 spark-overs/minute. If the measured present sparking rate has not reached 8 spark-overs/minute a rapping event is not allowed to be executed. The upper and lower safety limits are set to such values that the control of the rapping rate is normally controlled by the PID-controller as described hereinbefore. The PID-controller can also be restricted in such a way that the rapping rate can only be controlled within a certain range, for instance within the range of 5 to 20 rapping events/hour for bus-section 16. Thus, the PID-controller, which controls the rapping rate based on the measured present sparking rate, is allowed to control the rapping rate only within a certain safe "window", in which there is no risk of mechanical or electrical damage to the ESP. It will be appreciated that it is also possible to utilize other types of controllers and/or control technology, as alternative to the PID-controller type, for controlling the rapping rate.

In order to obtain a more stable rapping rate and to filter out occasional disturbances the control unit 68 could implement the decision as to when to change the setting of the rapping rate of the rapping device 44, based on several preceding rapping events. For instance, the control unit 68 could calculate an average sparking rate from 10 preceding rapping events. Based on the average of the sparking rate at the start of rapping obtained therefrom the control unit 68 could then effect a change of the rapping rate of the sparking device 44 with the aim of ultimately arriving at an average of the sparking rate at the start of rapping, which is very close to NR2.

With reference to FIG. 4, FIG. 5 and FIG. 6, it has been hereinbefore described how the rapping rate of the bus-section 16 may be controlled. It will thus be appreciated that it is possible to also control the rapping of the bus-section 18 of the first field 10 in the same manner as that, which has been described hereinbefore with regard to bus-section 16, i.e., by employing the control unit 70 to effect control of the rapping performed by the rapping device 46. Further, it is also possible to employ the same control method with both the bus-section 20 and the bus-section 22 of the second field 12. In principle it is possible to control the rapping of any bus-section in accordance with the methods described hereinbefore with reference to FIGS. 4, 5 and 6. In some cases, however, it is not beneficial to allow such a thick cake of dust particles to form on the collecting electrode plates 30 of the bus-sections 24, 26 of the last field 14 that spark-overs occur, because such a thick cake of dust particles would cause a large dust particle emission peak, sometimes visible as a plume, upon rapping the collecting electrode plates 30. While the main objective of the first fields, i.e., fields 10 and 12, is to obtain maximum removal of dust particles, the main objective of the last field, field 14, is often to remove the last few percentages of dust particles, and to avoid any visible plumes.

In an electrostatic precipitator 1 having N fields in series, N often being 2-6, the method described with reference to FIGS. 4-6 is preferably employed with respect to the fields with number M=1 to N-X, where X is usually 1-2. For example, in the electrostatic precipitator 1 shown in FIG. 1 and having 3 fields in series, the method described with reference to FIGS. 4-6 is preferably employed with respect to the first and second fields 10 and 12, respectively, i.e. N=3 and X=1. For an electrostatic precipitator 1 having 5 fields, the method described with reference to FIGS. 4-6 is preferably employed with respect to the first three or four fields, i.e., N=5 and X=1 or 2.

It will be appreciated that although the electrostatic precipitator 1 is shown in FIG. 3 as having two parallel rows of bus-sections, where bus-sections 16, 20 and 24 form a first row 82 and bus-sections 18, 22 and 26 form a second row 84, the inventive method of FIGS. 4-6 may be employed with an electrostatic precipitator 1 having any number of parallel rows, for instance 1-4 parallel rows of bus-sections.

The method described hereinbefore with reference to FIG. 4-6 provides a number of advantages when compared to the prior art. As has been described hereinbefore a method is described which makes it possible to measure, on-line, the present load of dust particles on the collecting electrode plates 30. That load which is measured is not the exact load in kilograms, but an indirect load which is related to the load capacity of the collecting electrode plates 30 at the present conditions. This method of measuring the load on the collecting electrode plates 30 takes into account all relevant parameters, such as the properties of the flue gas 4, the properties of the dust particles, the properties of the collecting electrode plates 30, etc., and is therefore more meaningful than a mass-based load measurement. In accordance with a preferred embodiment the load measurement is used for controlling when the collecting electrode plates are to be rapped. In particular such controlling provides control over when rapping is performed such that rapping is only performed when it is needed, i.e., when the emission of dust particles has begun to rise faster. In accordance with the method described hereinbefore, with reference to FIG. 4-6, the sparking rate of an individual bus-section 16-26 at a certain moment in time is used as an indirect measure of the load of dust particles, at that certain moment in time, on the collecting electrode plates 30 of that bus-section 16-26. Based on the estimated present load of dust particles on the collecting electrode plates 30 the rapping can be controlled so as to occur before the dust particle emission EC has increased to high levels. Furthermore, rapping is controlled so as to not occur so often that the dust particle emission occurring due to re-entrainment of dust in connection with rapping becomes significant. Further, by not rapping too often, the wear on the hammers 56, 58 of the rapping devices 44-54 as well as the power consumption related thereto is kept at a low level.

According to a second aspect of the present invention, a control method is employed in which the rapping of the individual bus-sections 16-26 is co-ordinated in order to thereby minimize the emission of dust particles from the overall electrostatic precipitator 1. When rapping is performed some of the dust particles previously collected on the collecting electrode plates 30 is again mixed with the flue gas 8 and leaves the electrostatic precipitator 1 as a dust particle emission peak in the flue gas 8, as described above. According to the technique employed in the prior art, the rapping is coordinated in such a way that a rapping event cannot be started simultaneously in two of the bus-sections 16-26. Thus, according to the technique employed in the prior art, bus-section 16 is not allowed to be rapped simultaneously with bus-section 18, since that could cause a double-sized peak, when dust particles simultaneously released from the bus-section 16 and from the bus-section 18 during rapping leave the electrostatic precipitator 1 with the flue gas 8.

Figure 7:
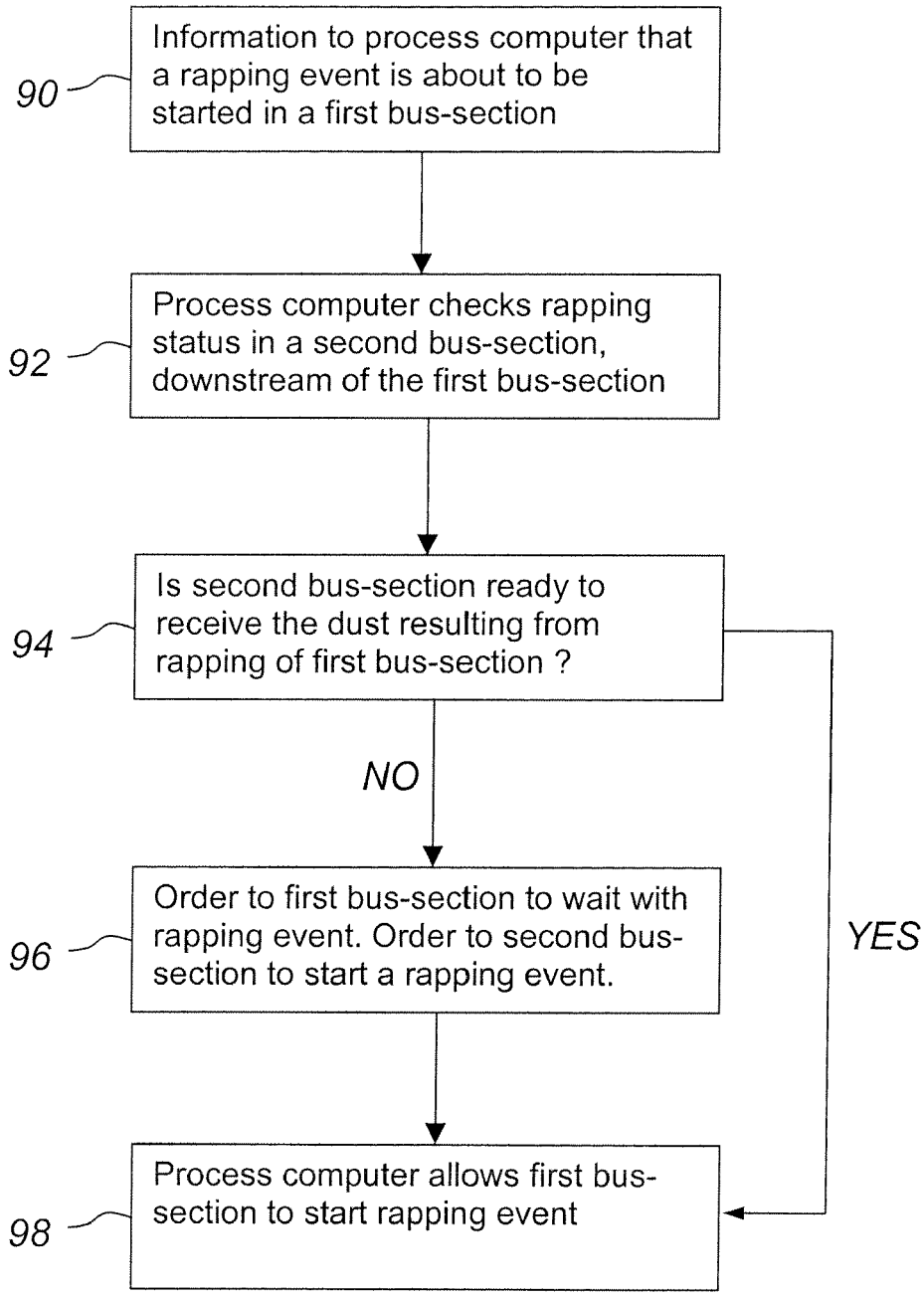
FIG. 7 is a flow diagram and illustrates the control of rapping of two subsequent bus-sections.

FIG. 7 illustrates a sequence of steps of a method in accordance with a first embodiment of the second aspect of the present invention. In the example illustrated in FIG. 7, reference is made for illustrative purposes to bus-sections 16 and 20, which are shown in FIGS. 2 and 3. The method can be applied to any two, or more, bus-sections of an ESP, as long as one of the bus-sections is located downstream of the other. In accordance with this first embodiment of the second aspect of the present invention, it is made sure that, before a bus-section is rapped, a bus-section located downstream of the bus-section that is to be rapped is capable of removing the dust particles that are re-entrained during the rapping of the upstream bus-section. FIG. 7 illustrates a first embodiment that accomplishes this effect. In a first step 90, the process computer 80 is provided with an input from a control unit, e.g., the control unit 68, of a first bus-section, e.g., bus-section 16, to the effect that the control unit 68 intends to initiate a rapping event in the near future, for example, within 3 minutes. In a second step 92, the process computer 80 inquires of the control unit, e.g., the control unit 72, of a second bus-section, e.g., bus-section 20, which is located immediately downstream of the first bus-section 16, regarding the rapping status of the collecting electrode plates 30 of this second bus-section 20, i.e., the process computer 80 wants to know when and how the collecting electrode plates 30 of the bus-section 20 were last rapped. In a third step 94, the process computer 80 determines whether the second bus-section 20 is or is not capable of receiving the increased emission of dust particles that will occur during rapping of the first bus-section 16. A criterion for this may be the time that has elapsed since the latest rapping of the second bus-section 20. If the collecting electrode plates 30 of the second bus-section 20 have not been rapped for some time, for example, if they have not been rapped within the preceding 10 minutes, then the process computer 80 may determine that the second bus-section 20 is not ready to receive the increased emission of dust particles arising from the rapping of the first bus-section 16, i.e., the answer to the question in the third step 94, which is shown in FIG. 7, is "NO", and thereby the process computer 80 proceeds to fourth step 96. In the fourth step 96, the process computer 80 instructs the control unit 68 of the first bus-section 16 to wait before starting the rapping event and concomitantly instructs the control unit 72 of the second bus-section 20 to immediately start a rapping event. The control unit 72 of the second bus-section 20 then instructs its rapping device, i.e., the rapping device 48, to perform a rapping of the collecting electrode plates 30 of the second bus-section 20. When the rapping of the second bus-section 20 has been completed the collecting electrode plates 30 of the second bus-section 20 have been cleaned and as such once again now have full dust collecting capability. By the rapping being "completed" is meant that the rapping device 48 has stopped its operation. Optionally a relaxation time, of about 0.5-3 minutes, is allowed after the rapping device 48 has stopped its operation, until the rapping is regarded as being "completed". During the relaxation time, any dust released from the collecting electrode plates 30 of the second bus-section 20 have time to either fall down into the hopper 64 or to leave the second bus-section 20 and enter a downstream bus-section. In a fifth step 98, the process computer 80 allows the control unit 68 of the first bus-section 16 to start a rapping event by activating the rapping device 44. If the answer is "YES" in the third step 94, which means that the second bus-section 20 is capable of receiving dust particles from the rapping of the first bus-section 16 without the second bus-section 20 being rapped first, then the process computer 80 proceeds immediately from the third step 94 to the fifth step 98 and thus the first bus-section 16 is allowed to start a rapping event, as illustrated in FIG. 7.

Figure 8A:
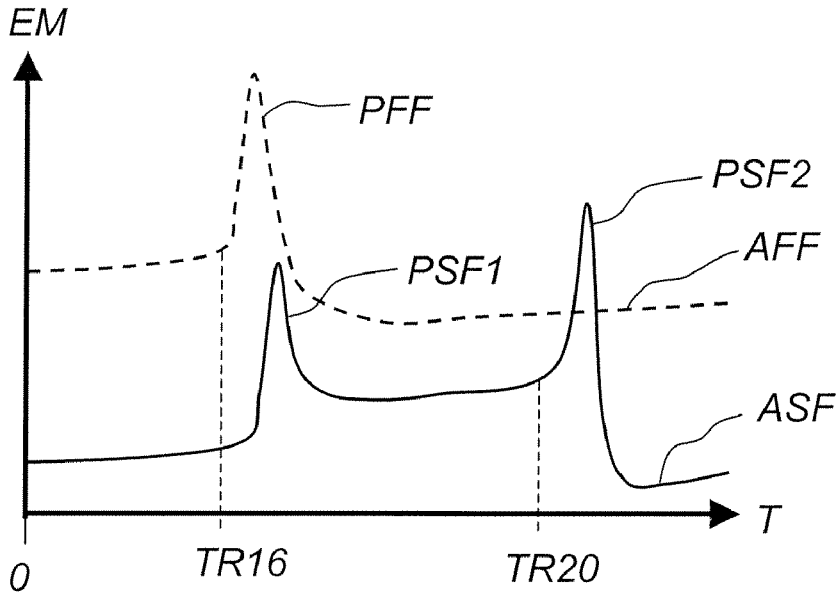
Prior art Fig. 8a
FIG. 8*a* is a diagrammatical illustration of the emission of dust particles according to prior art rapping control.

FIG. 8*a* is an example of the operation in accordance with a prior art method and illustrates by means of curve AFF therein, the emission of dust particles EM as measured after bus-section 16 of the first field 10, and by means of curve ASF therein, the emission of dust particles EM as measured after bus-section 20 of the second field 12. At the time indicated in FIG. 8*a* by TR16 a rapping is performed in the bus-section 16. As can be seen from a reference to FIG. 8*a* the rapping in the bus-section 16 results in a dust particle emission peak PFF measured after the bus-section 16. In accordance with the conditions illustrated in FIG. 8*a*, the collecting electrode plates 30 of the bus-section 20 have not been rapped for quite some time. Thus, the collecting electrode plates 30 of the bus-section 20 are quite "full" with dust particles. The dust particle emission peak PFF after the bus-section 16 results in a large dust particle emission peak, which is indicated in FIG. 8*a* by PSF1, after the bus-section 20, since the collecting electrode plates 30 of the bus-section 20 already carry a large amount of dust particles and cannot remove, due to increased sparking and a resulting decrease in the voltage of the bus-section 20, a sufficient amount of the increased amount of dust particles, which are released by the rapping of the bus-section 16 that occurs at time TR16. To sum up, the large amount of dust particles released from the bus-section 16 during the rapping thereof causes the bus-section 20, which was already quite "full", to reach a state of high sparking rate, resulting in decreased voltage and a decreased dust removal capability. Since the control unit 72 of the bus-section 20 is not allowed, in accordance with the method of the prior art, to start a rapping event at the same time as, i.e., while, the bus-section 16 is in its rapping event, the bus-section 20 has to await some period of time until a rapping event may be started. When a rapping event is finally started in bus-section 20, at time TR20, the rapping of the overfilled collecting electrode plates 30 of bus-section 20 will result in another dust particle emission peak, which is indicated in FIG. 8*a* at PSF2 measured after the bus-section 20. Thus, in accordance with the method of the prior art, which is illustrated in FIG. 8*a*, two large dust particle emission peaks, indicated at PSF1 and PSF2, respectively, have occurred. These peaks, indicated in FIG. 8*a* at PSF1 and PSF2, will lead to an increased emission of dust particles measured also after any other bus-sections, e.g., after bus-section 24, located downstream of the bus-section 20 and will result in an increased emission of dust particles as measured in the flue gas 8 leaving the electrostatic precipitator 1. Accordingly, the control scheme in accordance with the prior art method illustrated in FIG. 8*a* results in a high degree of emission of dust particles.

Figure 8B:
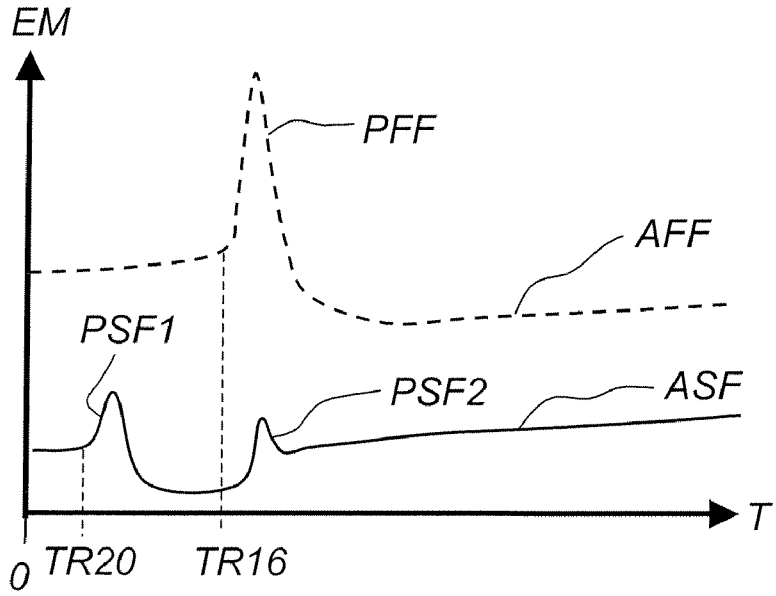
FIG. 8*b* is a diagrammatical illustration of the emission of dust particles when controlling the rapping according to the flow diagram of FIG. 7.

FIG. 8*b* illustrates the emission of dust particles when operating according to the second aspect of the present invention, which has been described above with reference to FIG. 7. The emission of dust particles EM as measured after bus-section 16 of the first field 10 is depicted by the curve AFF in FIG. 8*b*, and the emission of dust particles EM as measured after bus-section 20 of the second field 12 is depicted by the curve ASF in FIG. 8*b*. According to the illustration in FIG. 8*b* of this method in accordance with the second aspect of the invention the control unit 68 of the bus-section 16 informs, in the first step 90, the process computer 80 that the control unit 68 intends to start a rapping event soon, e.g., within the next 3 minutes. The process computer 80 then checks in accordance with the second step 92 depicted in FIG. 7, as a response to receiving this information from the control unit 68 of the bus-section 16, the rapping status of the bus-section 20, the bus-section 20 being located downstream of the bus-section 16. In the third step 94 shown in FIG. 7, the process computer 80 determines, based on a suitable criterion, such as that a rapping event must have been started in the latest 10 minutes in the bus-section 20, or that the sparking rate of the bus-section 20 must be below a selected threshold value, that the bus-section 20 is not ready to receive the dust particles arising from a rapping event in the bus-section 16, i.e., the answer to the question, which is depicted in step 94 in FIG. 7, is "NO". The outcome of this check results in that the process computer 80 instructs, in accordance with the fourth step 96 shown in FIG. 7, the control unit 72 of the bus-section 20 to start a rapping event, by activating the rapping device 48, substantially immediately. The bus-section 16 has not been allowed to start a rapping event until the rapping event of bus-section 20 has been completed. The rapping of the bus-section 20 is performed at the time TR20 shown in FIG. 8*b*. The rapping of the second bus-section 20 at the time TR20 results in the dust particle emission peak PSF1 shown in FIG. 8*b*. Since the rapping event of the bus-section 20 is started before the collecting electrode plates 30 are full, the peak PSF1 resulting from the rapping event in the bus-section 20 is quite small, as seen in FIG. 8*b*. When the process computer 80 concludes that the rapping event of the bus-section 20 has been completed, i.e., that the rapping device 48 has stopped its operation and after which a period of, e.g., 2 minutes of relaxation has elapsed, the process computer 80 allows, in accordance with the fifth step 98 depicted in FIG. 7, the control unit 68 of the bus-section 16 to start a rapping event. The rapping event of the bus-section 16 is executed by means of the rapping device 44 at the time TR16 that is shown in FIG. 8*b*. The curve AFF depicted in FIG. 8*b*, which curve AFF illustrates the emission of dust particles after the bus-section 16, can be seen to be similar to that of FIG. 8*a*, since the rapping of the bus-section 16 is not affected. Thus, the rapping of the bus-section 16 results, also in this case, in the dust particle emission peak PFF, which is shown in FIG. 8*b*. In contrast to the prior art, which is illustrated in FIG. 8*a*, the second bus-section 20 has, at the time TR16, clean collecting electrode plates 30. Due to this fact, the bus-section 20 is well prepared to absorb the dust particle emission peak PFF resulting from the rapping event of the bus-section 16. As will be readily apparent from a reference to FIG. 8*b* the rapping of the bus-section 16 at time TR16 results in a small dust particle emission peak PSF2 after the bus-section 20.

Figure 9:
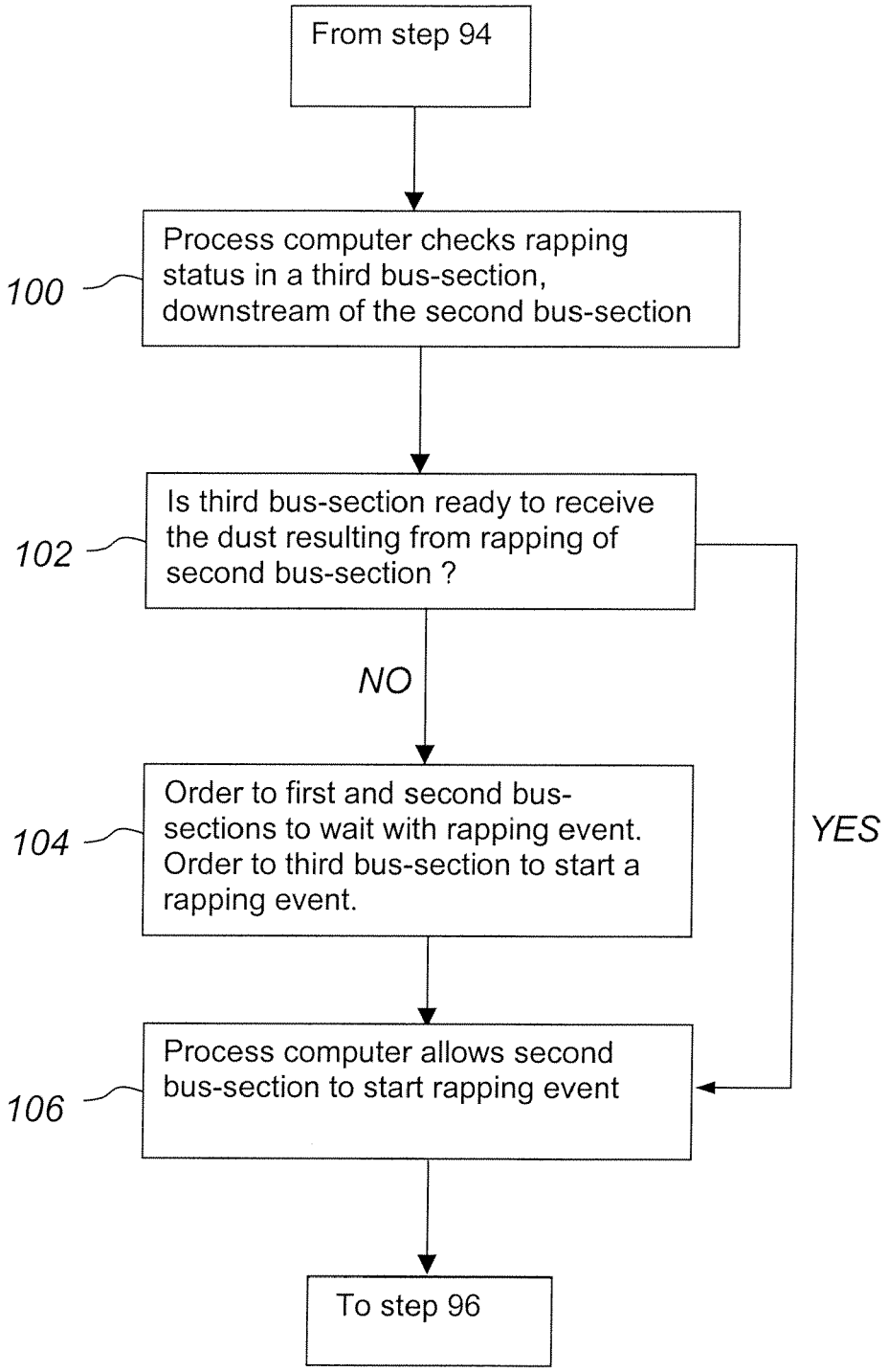
FIG. 9 is a flow diagram and illustrates the control of rapping in a further subsequent bus-section.

Comparing the prior art method, which is illustrated in FIG. 8*a*, with the method of the second aspect of the present invention, which is illustrated in FIG. 8*b*, it can be seen from such comparison that the two dust particle emission peaks PSF1 and PSF2, as shown in FIG. 8*b*, are much smaller than the two dust particle emission peaks PSF1 and PSF2, as shown in FIG. 8*a* that are obtained when the prior art method, which is illustrated in FIG. 8*a*, is employed. Thus, the method illustrated in FIG. 7 makes it possible to substantially decrease the dust particle emission after an electrostatic precipitator 1 using the same mechanical components, but controlling them, in accordance with the first embodiment of the second aspect of the present invention, in a new and inventive manner. Accordingly, by employing the control method in accordance with the present invention, it may then be possible to meet a dust particle emission requirement, e.g., 10 mg/Nm$^3$ dry gas in the flue gas 8 as a 6 minute rolling average, with fewer fields than with prior art methods. The control method described hereinbefore with reference to FIGS. 7 and 8*b*, will maximize the removal efficiency of the electrostatic precipitator 1. In some cases this will make it possible to manage the emission demands with fewer fields, or with smaller or fewer collecting electrode plates, compared to what is possible when controlling the ESP in accordance with the method of the prior art technique. FIG. 9 illustrates a second embodiment of the second aspect of the present invention. According to this embodiment the process computer 80 makes use of a further step before the process computer 80 allows a rapping event to start in the first bus-section 16. To this end, the steps that are illustrated in FIG. 9 are inserted between the steps 94 and 96 that are illustrated in FIG. 7, and are normally employed only if the answer to the question in step 94 is "NO". As best understood with reference to FIG. 9, in step 100 the process computer 80 checks the rapping status in a third bus-section, e.g., in the bus-section 24, which is located immediately downstream of the second bus-section, e.g., bus-section 20. Continuing with reference to FIG. 9, in step 102 the process computer 80 determines whether the third bus-section 24 is or is not capable of receiving the increased emission of dust particles that would occur during the rapping event of the second bus-section 20. A criterion for this may be the time that has elapsed since the start of the latest rapping event of the third bus-section 24 in relation to a selected time, or the sparking rate of the third bus-section 24 in relation to a selected threshold sparking rate. Said selected time or said selected threshold sparking rate is selected such as that the third bus-section 24 would be able to capture the increased emission of dust particles that would occur during the rapping event of the second bus-section 20 if the actual time or the actual sparking rate is below said selected time or said selected threshold sparking rate, respectively. If the collecting electrode plates 30 of the third bus-section 24 have not been rapped for some time, for instance, have not been rapped within the last 10 hours, or if the sparking rate is above, e.g., 12 spark-overs per minute, then the process computer 80 may determine that the third bus-section 24 is not ready to receive the increased emission of dust particles that would result from the rapping of the second bus-section 20, i.e., the answer to the question in step 102, which is depicted in FIG. 9, is "NO", and as such the process computer 80 proceeds to step 104, which is depicted in FIG. 9. In the step 104 the process computer 80 instructs the control unit 68 of the first bus-section 16 and the control unit 72 of the second bus-section 20 to wait before starting a rapping event. The process computer 80 also instructs the control unit 76 of the third bus-section 24 to start substantially immediately a rapping event by activating the rapping device of the third bus-section 24, e.g., the rapping device 52. When the rapping event of the third bus-section 24 has been completed, the collecting electrode plates 30 of the third bus-section 24 will have full dust collecting capability. Finally, in accordance with step 106, which is shown in FIG. 9, the process computer 80 allows the control unit 72 of the second bus-section 20 to start a rapping event as a result of the activation of the rapping device 48. The rapping of the second bus-section 20 is then performed according to step 96, shown in FIG. 7. If the answer is "YES" in the step 102, i.e., that the third bus-section 24 has recently been rapped, then the process computer 80, with reference to FIG. 9, proceeds immediately from step 102 to step 106 and thus the second bus-section 20 is immediately allowed to start a rapping event, according to step 96 that is shown in FIG. 7.

While it has been described hereinbefore that the time since a rapping has been performed in the downstream bus-section is taken as a measure of whether that bus-section needs to be rapped or not prior to the rapping of an upstream bus-section, it will be appreciated that alternative embodiments are also possible. For instance, it is possible to measure the present sparking rate in the downstream bus-section, as has been described hereinbefore in connection to the first aspect of the present invention, and to use the measured present sparking rate as an indication of the present load on the collecting electrode plates 30 of the downstream bus-section. Thus, the control unit 68 can decide, based on the measured present sparking rate in the downstream bus-section, if the downstream bus-section needs to be rapped prior to rapping the upstream bus-section.

Figure 10:
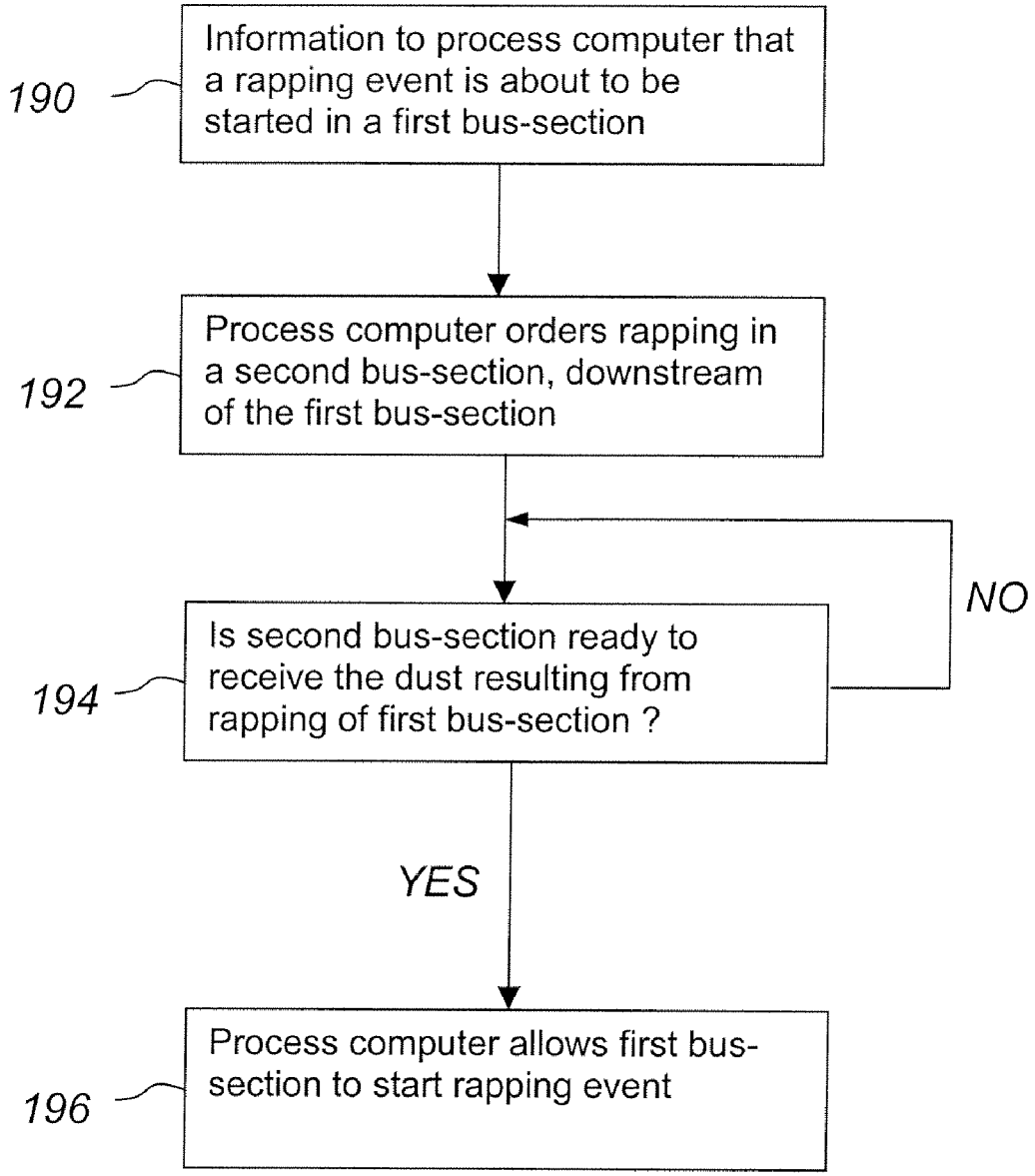
FIG. 10 is a flow diagram and illustrates the control of rapping of two subsequent bus-sections in accordance with an alternative embodiment.

FIG. 10 illustrates a third embodiment of the second aspect of the present invention. In this third embodiment the control of the rapping of the upstream first bus-section is performed in such a way, that the rapping of the upstream first bus-section must be preceded by a rapping of the downstream second bus-section. In a first step 190, the process computer 80 is provided with an input from a control unit, e.g., the control unit 68, of a first bus-section, e.g., bus-section 16, to the effect that the control unit 68 intends to initiate a rapping event in the near future, for example, within 3 minutes. In a second step 192, the process computer 80 instructs the control unit, i.e., the control unit 72, of a second bus-section, i.e. the bus-section 20, which is located downstream of the first bus-section 16, to immediately start a rapping event. The control unit 72 of the second bus-section 20 then instructs its rapping device, i.e., the rapping device 48, to perform a rapping of the collecting electrode plates 30 of the second bus-section 20. In a third step 194 the process computer 80 checks if the rapping of the second bus-section 20 has been completed such that the collecting electrode plates 30 of the second bus-section 20 have been cleaned and have full dust collecting capability. If the check in the third step 194 gives the output "NO", then the check of the third step 194 is repeated after some time, e.g., after 30 seconds, until the output is "YES", by which is meant that the collecting electrode plates 30 of the second bus-section 20 have been cleaned and are ready to collect the dust particle emission that will be caused by the rapping of the collecting electrode plates 30 of the first bus-section 16. In a fourth step 196, the process computer 80 allows the control unit 68 of the first bus-section 16 to start a rapping event, as illustrated in FIG. 10. It will be appreciated that the third embodiment of the second aspect of the present invention, as described with reference to FIG. 10, provides a method in which the downstream second bus-section is automatically rapped before the upstream first bus-section is rapped. In this manner it will always be ensured that the downstream second bus-section will be ready to collect the dust particle emission resulting from the rapping of the upstream first bus-section. The upstream first bus-section will act as the main dust particle collector, while the downstream second bus-section acts as a guard bus-section, which removes any remaining dust particles not collected in the upstream first bus-section.

While it has been described hereinbefore, with reference to FIG. 10, that the downstream second bus-section 20 is rapped prior to each rapping of the upstream first bus-section 16, it is also possible to control the rapping of the downstream second bus-section 20 in alternative manners. According to one alternative manner a rapping event of the downstream second bus-section 20 is initiated only prior to every second occasion of initiating a rapping event in the upstream first bus-section 16, such that two consecutive rapping events of the upstream first bus-section 16 will correspond to one rapping event of the downstream second bus-section 20. Obviously, in some cases it may even be sufficient to initiate a rapping event of the downstream second bus-section 20 prior to every third, or every fourth or more, occasion of initiating a rapping event in the upstream first bus-section 16, when operating in accordance with this third embodiment of the second aspect of the present invention, illustrated in FIG. 10.

Furthermore, it has been described hereinbefore that the process computer 80 checks if a rapping event of a downstream bus-section has been finalized, until it allows an upstream bus-section to initiate a rapping event. A further possibility is to design the control method in such a manner that the finalization of a rapping event in a downstream bus-section automatically triggers the initiation of the rapping event of the upstream bus-section. Such a control may in some cases result in a faster control of the rapping.

Figure 11:
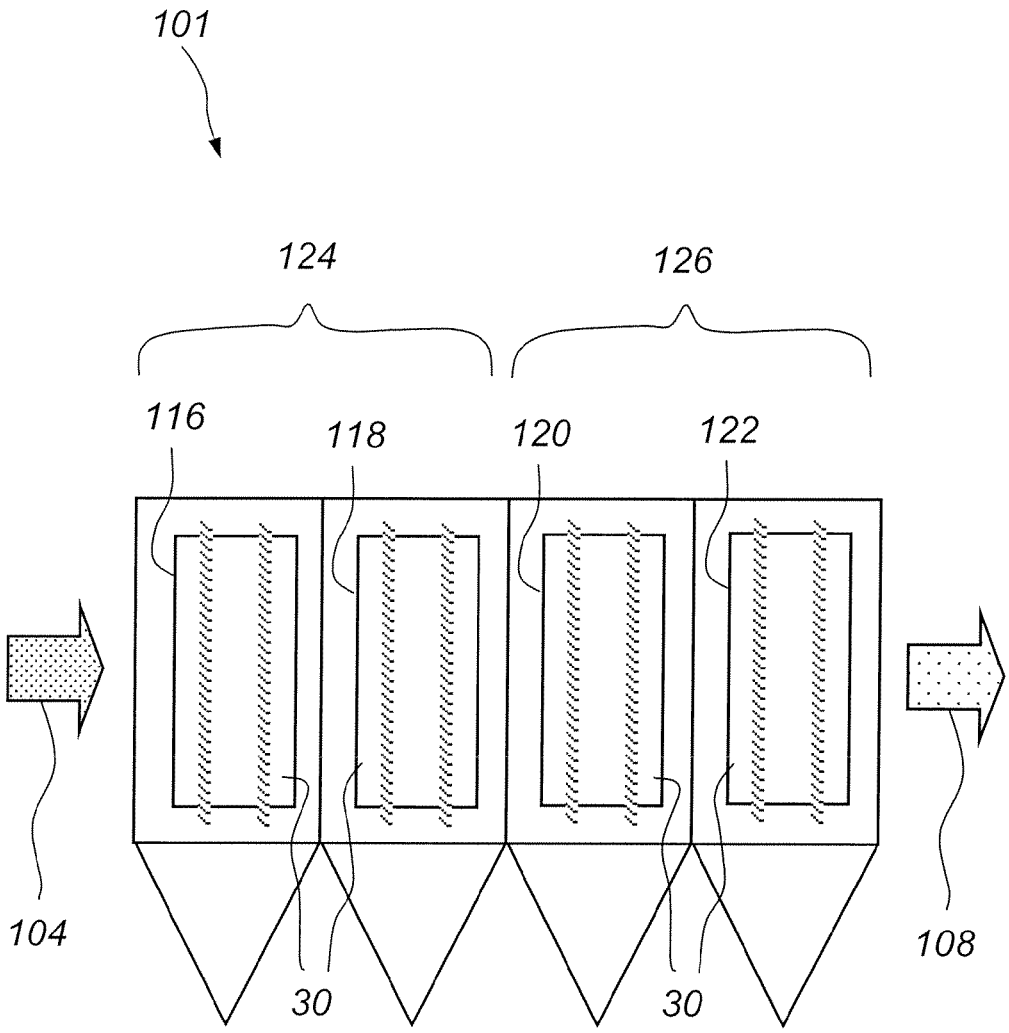
FIG. 11 is a side view and shows an electrostatic precipitator as seen from the side.

FIG. 11 illustrates a fourth embodiment of the second aspect of the present invention. FIG. 11 illustrates, schematically, an electrostatic precipitator, ESP, 101 having four bus-sections 116, 118, 120 and 122 placed in series. The flue gas 104 enters the first bus-section 116, then continues further to the second bus-section 118, to the third bus-section 120, and, finally, to the fourth bus-section 122. The cleaned flue gas 108 leaves the fourth bus-section 122. The first bus-section 116 and the second bus-section 118 form a first pair 124 of bus-sections in which the first bus-section 116 will operate as the main collecting unit, and the second bus-section 118 will operate as a guard bus-section collecting dust particles that have not been removed by the first bus-section 116. The first bus-section 116 and the second bus-section 118 of the first pair 124 of bus-sections may thus be operating in the manner that has been described hereinbefore with reference to FIG. 10, i.e., a process computer, not shown, will order a rapping event in the second bus-section 118, prior to allowing the first bus-section 116 to perform a rapping event. The third bus-section 120 and the fourth bus-section 122 form a second pair 126 of bus-sections in which the third bus-section 120 will operate as the main collecting unit, and the fourth bus-section 122 will operate as a guard bus-section collecting dust particles that have not been removed by the third bus-section 120. The third bus-section 120 and the second bus-section 122 forming the second pair 126 of bus-sections 120, 122 may operate in the manner that has been described hereinbefore with reference to FIG. 10, i.e., a process computer, not shown, will order a rapping event in the fourth bus-section 122, prior to allowing the third bus-section 120 to perform a rapping event. The embodiment of FIG. 11 thus illustrates an ESP 101 in which each bus-section 116, 118, 120, 122 is controlled in an optimized manner for one specific task. The first and third bus-sections 116, 120 are controlled for maximum removal efficiency. It is preferred that the need for performing a rapping event in any of these two bus-sections 116, 120 is analyzed in the manner described hereinbefore with reference to FIG. 4-6, i.e., that the sparking rate is utilized as a measure of the present load of dust particles on the collecting electrode plates 30 of those bus-sections 116, 120. Still more preferably, the measured load of dust particles on the collecting electrode plates 30 of the bus-sections 116, 120, respectively, is utilized for controlling when the control unit, not shown in FIG. 11, of the respective bus-section 116, 120 should send a request to the process computer that a rapping event needs to be performed for that particular bus-section 116, 120. In that way the first and third bus-sections 116, 120 are only rapped when their respective collecting electrode plates 30 are full of dust particles. The second and fourth bus-sections 118, 122 are controlled to have maximum capability for removing the dust particles that have not been collected in the upstream bus-section 116, 120, respectively, and in particular to have maximum capability for removing the dust particle emission peaks generated during the rapping of the respective upstream bus-section 116, 120. In this manner, the bus-sections 118 and 120 may never become "full" on their own, the bus-sections 116 and 120 will remove the majority of the dust, and the bus-sections 118 and 122 will function as guard bus-sections to prevent the majority of re-entrained dust from the bus-section 116, 120, respectively, to exit the pair 124, 126 of bus-sections. The manner of dividing the ESP into pars of bus-sections as described with reference to FIG. 11 can be utilized for any ESP having an even number of bus-sections. For an ESP having an uneven number of bus-sections the last bus-section can be utilized as an extra guard bus-section, which is controlled for maximum removal of the dust particle emission peaks that occur during rapping of the guard bus-section of the last pair of bus-sections. In an ESP which is similar to the ESP 1 of FIGS. 1-3, having three bus-sections in series, the bus-sections 24 and 26 could have the function of being the extra guard bus-section. Due to the fact that the two bus-sections of each pair 124, 126 of bus-sections will have different main objectives, they could also be designed in different ways as regards the mechanical design, e.g., as regards the size and the number of collecting electrode plates 30, so as to further optimize the respective bus-section 116, 118, 120, 122 for its main objective.

According to the various embodiments of the second aspect of the present invention, as best understood with reference to FIG. 7, FIG. 8*b*, FIG. 9, FIG. 10 and FIG. 11, rapping is coordinated in such a way that the emission of dust particles from the electrostatic precipitator 1 is decreased compared to that of prior art methods. Thus, the various embodiments of the second aspect of the present invention makes it possible to decrease the emission of dust particles from an electrostatic precipitator 1 without having to change the mechanical design of the casing 9 and the contents thereof.

Several variants of the various embodiments of the first and seconds aspect of the present invention are possible without departing from the essence of the present invention.

For instance the process computer 80 may be designed to function such that the first row 82 of bus-sections and the second row 84 of bus-sections are operated in such a manner that rapping is not performed in both of the rows 82 and 84 at the same time. In particular it is deemed to be desirable to try to avoid having the bus-sections 16, 18 of the first field 10 rapped at the same time. To this end, the process computer 80 can be designed to handle this by effecting control of the rapping in such a way that rapping of the bus-sections 16 and 18 is performed in a staggered manner. By staggered manner is meant that the rapping of the bus-section 16 is followed by a waiting time of e.g., 3 minutes before bus-section 18 is rapped, then there is another waiting time of, e.g., 3 min after which the bus-section 16 is rapped again. The basic method of control would, however, be that which is illustrated in FIGS. 7, 8*b* and 9; namely, that rapping of a given bus-section is only allowed if it has been assured that a bus-section downstream of the given bus-section is capable of handling the increased emission of dust particles resulting from the rapping of the given bus-section.

The second embodiment of the second aspect of the present invention, which has been described hereinbefore with reference to FIG. 9, shows the following chain of procedural checks: in order to allow rapping in a first bus-section a check is first made in accordance with step 92 of FIG. 7, to determine if rapping is needed in the second bus-section. If rapping is required in the second bus-section then a check is made in accordance with step 100 of FIG. 9, to determine whether rapping is required in the third bus-section. Thus, all three bus-sections are linked together in such a way that a first check is made from the standpoint of the first bus-section with regard to the second bus-section, and a second check is then made from the standpoint of the second bus-section with regard to the third bus-section. An alternative to this way of linking the three consecutive bus-sections together is to make one combined check made from the standpoint of the first bus-section with regard to both the second and the third bus-sections, at the same time, to see if either the second bus-section or the third bus-section is in need of being rapped before a rapping can be performed in the first bus-section.

It will also be appreciated that in some instances a rapping of the second bus-section, e.g. bus-section 20, may be initiated for another reason other than the fact that the bus-section 16 is to be subjected to the start of a rapping event. For instance, it could happen that the sparking rate of the second bus-section 20 has reached the value NR2 as determined by the first aspect of the present invention, which has been described herein previously in connection with a reference to FIGS. 4-6. In such an instance the start of a rapping event in the second bus-section 20 is triggered by the second bus-section 20 itself and not by the fact that some specified conditions exists in an upstream bus-section. It is preferable, also in such a case, to check, before a rapping event is allowed to be started in the bus-section 20, the rapping status of a downstream bus-section, e.g., bus-section 24, to determine whether the latter is required to be rapped. In such a case, the operation would be similar to that described hereinbefore with reference to FIG. 7, with the bus-section 20 performing the function of the first bus-section and the bus-section 24 performing the function of the second bus-section insofar as the steps indicated in FIG. 7 are concerned.

It will further be appreciated that the first, second and third embodiments of the second aspect of the present invention, which has been described hereinbefore with reference to FIGS. 7, 8*b*, 9, and 10, have been illustrated for three consecutive bus-sections 16, 20, 24. Furthermore, the fourth embodiment of the second aspect of the present invention, which has been described hereinbefore with reference to FIG. 11, has been illustrated for four consecutive bus-sections 116, 118, 120, 122. However, it is to be understood that the second aspect of the present invention, without departing from the essence thereof, is useful with any number of consecutive bus-sections from 2 or more. Often the second aspect of the present invention would be employed with 2-5 consecutive bus-sections, i.e., electrostatic precipitators 1 having 2-5 fields. It has been described hereinbefore that the first two, three or four bus-sections of the electrostatic precipitator are controlled. It will be appreciated that it is also possible, without departing from the essence of the second aspect of the present invention, to avoid controlling that bus-section/-s located closest to the inlet of the electrostatic precipitator. In an electrostatic precipitator having 6 consecutive bus-sections numbered 1-6 it would thus be possible to control only bus-section number 3-5 in accordance with the second aspect of the present invention, in which case bus-section number 3 would be regarded as the "first bus-section", bus-section number 4 would be regarded as the "second bus-section" etc. It is thus clear, that the second aspect of the present invention could be applied to any two or more consecutive bus-sections located anywhere in an electrostatic precipitator, and that the "first bus-section" need not necessarily be that bus-section being located closest to the inlet of the electrostatic precipitator. Furthermore, the "second bus-section" need not be located immediately downstream of the "first bus-section", it may also be located further downstream of the "first bus-section". However, it is often preferred that the "second bus-section" is located immediately downstream of the "first bus-section".

The first aspect of the present invention, which has been described hereinbefore with reference to FIGS. 4-6, can be utilized for each bus-section of an electrostatic precipitator having one or more bus-sections.

It will be appreciated that numerous variants of the above described embodiments are possible within the scope of the appended claims.

As described and illustrated herein, the process computer 80 functions to control all of the control units 68-78. It is also possible, however, without departing from the essence of the present invention, to arrange one of the control units, preferably control unit 76 or control unit 78 located in the last field 14, such that said one of the control units functions as a master controller having control over the other control units and operative to send instructions to the other control units.

Hereinabove it has been described that hammers are used for rapping. It is also possible, however, without departing from the essence of the present invention, to execute the rapping with other types of rappers, such as for instance, with so-called magnetic impulse gravity impact rappers, also known as MIGI-rappers.

According to what is depicted in FIG. 1, each rapping device 44, 48, 52 is provided with a first set of hammers 56 adapted for rapping the upstream end of the respective collecting electrode plate 30, and a second set of hammers 58 adapted for rapping the downstream end of the respective collecting electrode plate 30. It will be appreciated that, as alternative, each rapping device could be provided with only one of the first set of hammers 56 and the second set of hammers 58, such that each collecting electrode plate 30 is rapped on either its upstream end, or on its downstream end.

The invention claimed is:

1. A method of controlling dust particle emission from an electrostatic precipitator, the method comprising:

utilizing in said electrostatic precipitator at least a first bus-section and at least a second bus-section each of which comprising at least one collecting electrode plate, at least one discharge electrode, and a power source;

observing that a rapping event of the first bus-section is about to be initiated, said rapping event comprising rapping at least one collecting electrode plate of the first bus-section for the purpose of removing dust particles accumulated thereon;

verifying, before allowing the rapping event of said first bus-section to be initiated, that the second bus-section located downstream of said first bus-section is ready to receive the dust particles to be released during the rapping event of said first bus-section; and initiating, after it has been verified that said second bus-section is ready to receive the dust particles to be released during the rapping event of said first bus-section, said rapping event of said first bus-section.

2. A method according to claim 1, wherein said second bus-section is located immediately downstream of said first bus-section.

3. A method according to claim 1, wherein said first bus-section is located at the flue gas inlet of the electrostatic precipitator.

4. A method according to claim 1, wherein said electrostatic precipitator comprises any number of bus-sections, at least three of said any number of bus-sections forming a group of bus-sections, said group of bus-sections comprising at least a first bus-section, a second bus-section located downstream of said first bus-section, and a third bus-section located downstream of said second bus-section, the rapping of each of said bus-sections of said group of bus-sections controlled by observing that a rapping event of one of the bus-sections of said group of bus-sections is about to be initiated, verifying, before allowing the rapping event of said one of the bus-sections to be initiated, that a bus-section comprised in said group of bus-sections and located immediately downstream of said one of the bus-sections is ready to receive the dust particles to be released during the rapping event of said one of the bus-sections, and initiating, after it has been verified that said bus-section comprised in said group of bus-sections and located immediately downstream of said one of the bus-sections is ready to receive the dust particles to be released during the rapping event of said one of the bus-sections, said rapping event of said one of the bus-sections.

5. A method according to claim 1, wherein said electrostatic precipitator comprises at least three consecutive bus-sections, said step of verifying that said second bus-section is ready to receive the dust particles to be released during the rapping event of said first bus-section further comprising the step of verifying, in the event it has been established that a rapping event needs to be executed in the second bus-section prior to initiating said rapping event of said first bus-section and before allowing said rapping event of said second bus-section to be initiated, that a third bus-section located downstream of said second bus-section is ready to receive the dust particles to be released during the rapping event of said second bus-section.

6. A method according to claim 1, wherein said electrostatic precipitator comprises any number of bus-sections, an even number of said any number of bus-sections being divided into pairs of bus-sections, each said pairs of bus-sections comprising a first bus-section (116, 120), and a second bus-section located downstream of said first bus-section, the rapping of said first and second bus-sections of each pair of said pairs of bus-sections controlled by observing that a rapping event of the first bus-section of said pair is about to be initiated, verifying, before allowing the rapping event of said first bus-section to be initiated, that the second bus-section of said pair is ready to receive the dust particles to be released during the rapping event of said first bus-section, and initiating, after it has been verified that said second bus-section is ready to receive the dust particles to be released during the rapping event of said first bus-section, said rapping event of said first bus-section of said pair.

7. A method according to claim 1, said electrostatic precipitator comprising at least four consecutive bus-sections, said method further comprising the steps of observing that a rapping event of a third bus-section of the electrostatic precipitator is about to be initiated, said third bus-section located downstream of said second bus-section, said rapping event comprising rapping at least one collecting electrode plate of the third bus-section for the purpose of removing dust particles accumulated thereon;

verifying, before allowing the rapping event of said third bus-section to be initiated, that a fourth bus-section located downstream of said third bus-section is ready to receive the dust particles to be released during the rapping event of said third bus-section; and initiating, after it has been verified that said fourth bus-section is ready to receive the dust particles to be released during the rapping event of said third bus-section, said rapping event of said third bus-section.

8. A method according to claim 1, wherein said step of verifying that the second bus-section is ready to receive the dust particles to be released during the rapping event of said first bus-section, further comprises measuring the present sparking rate between said at least one collecting electrode plate and said at least one discharge electrode of said second bus-section; and initiating, in the event said measured present sparking rate of said second bus-section exceeds a selected sparking rate, a rapping event of said second bus-section, such that at least one collecting electrode plate of said second bus-section is rapped, prior to said step of initiating said rapping event of said first bus-section.

9. A method according to claim 1, wherein said step of verifying that said second bus-section is ready to receive the dust particles to be released during the rapping event of said first bus-section, further comprises determining the time that has elapsed since said second bus-section was last rapped, and, if said time that has elapsed since said second bus-section was last rapped exceeds a selected time, initiating a rapping event of said second bus-section, such that at least one collecting electrode plate of said second bus-section is rapped, prior to said step of initiating said rapping event of said first bus-section.

10. A method according to claim 1, wherein said step of verifying that the second bus-section is ready to receive the dust particles to be released during the rapping event of said first bus-section, further comprises initiating a rapping event of said second bus-section, such that at least one collecting electrode plate of said second bus-section is rapped, prior to said step of initiating said rapping event of said first bus-section.

11. A method according to claim 1, wherein said step of verifying that the second bus-section is ready to receive the dust particles to be released during the rapping event of said first bus-section, further comprises predicting the need for rapping said at least one collecting electrode plate of said second bus-section prior to said step of initiating said rapping event of said first bus-section; and initiating, if found necessary by said prediction, a rapping event of said second bus-section, such that at least one collecting electrode plate of said second bus-section is rapped, prior to said step of initiating said rapping event of said first bus-section.

12. A control system for controlling the operation of an electrostatic precipitator, said control system comprising:

a control device being adapted for receiving input that a rapping event of a first bus-section of the electrostatic precipitator is about to be initiated, said rapping event comprising rapping at least one collecting electrode plate of the first bus-section for the purpose of removing dust particles accumulated thereon, said control device being adapted for sending, in response to said input that a rapping event of a first bus-section of the electrostatic precipitator is about to be initiated, an inquiry to a second bus-section located downstream of said first bus-section, concerning whether said second bus-section is ready to receive the dust particles to be released during the rapping event of said first bus-section, said control device being adapted for initiating, after it has been verified that said second bus-section is ready to receive the dust particles to be released during the rapping event of said first bus-section, said rapping event of said first bus-section.

13. A control system according to claim 12, wherein said second bus-section is located immediately downstream of said first bus-section.

14. A control system according to claim 12, wherein said first bus-section is located at the flue gas inlet of the electrostatic precipitator.

15. A control system according to claim 12, wherein said control system is adapted for controlling an electrostatic precipitator comprising any number of bus-sections, an even number of said any number of bus-sections being divided into pairs of bus-sections, each said pairs of bus-sections comprising a first bus-section, and a second bus-section located downstream of said first bus-section, the control system being adapted for controlling the rapping of said first and second bus-sections of each pair of said pairs of bus-sections by observing that a rapping event of the first bus-section of said pair is about to be initiated, verifying, before allowing the rapping event of said first bus-section to be initiated, that the second bus-section of said pair is ready to receive the dust particles to be released during the rapping event of said first bus-section, and initiating, after it has been verified that said second bus-section is ready to receive the dust particles to be released during the rapping event of said first bus-section, said rapping event of said first bus-section of said pair.

16. A control system according to claim 12, wherein said control system is adapted for controlling an electrostatic precipitator comprising any number of bus-sections, at least three of said any number of bus-sections forming a group of bus-sections, said group of bus-sections comprising at least a first bus-section, a second bus-sections located downstream of said first bus-section, and a third bus-section located downstream of said second bus-section, the rapping of each of said bus-sections of said group of bus-sections being controlled by observing that a rapping event of one of the bus-sections of said group of bus-sections is about to be initiated, verifying, before allowing the rapping event of said one of the bus-sections to be initiated, that a bus-section comprised in said group of bus-sections and located immediately downstream of said one of the bus-sections is ready to receive the dust particles to be released during the rapping event of said one of the bus-sections, and initiating, after it has been verified that said bus-section comprised in said group of bus-sections and located immediately downstream of said one of the bus-sections is ready to receive the dust particles to be released during the rapping event of said one of the bus-sections, said rapping event of said one of the bus-sections of said group of bus-sections.

17. A control system for controlling the operation of an electrostatic precipitator, said control system comprising:

a control device being adapted for receiving input that a rapping event of a first bus-section of the electrostatic precipitator is about to be initiated, said rapping event comprising rapping at least one collecting electrode plate of the first bus-section for the purpose of removing dust particles accumulated thereon, said control device being adapted for at least occasionally initiating, in response to said input that a rapping event of the first bus-section of the electrostatic precipitator is about to be initiated, a rapping event in a second bus-sections located downstream of the first bus-section, said control device being adapted for initiating said rapping event of the first bus-section, possibly after initiating the rapping event of the second bus-section.

* * * * *